US005559547A

United States Patent [19]

Hagar

[11] Patent Number: 5,559,547

[45] Date of Patent: Sep. 24, 1996

[54] THERMAL PRINTER

[75] Inventor: Gamal Hagar, Neckarsteinach, Germany

[73] Assignee: Esselte Meto International GmbH, Heppenheim, Germany

[21] Appl. No.: 311,778

[22] Filed: Sep. 23, 1994

[30] Foreign Application Priority Data

Sep. 24, 1993 [DE] Germany ..... 43 32 572.6

[51] Int. Cl.[6] ..... B41J 2/32; B41J 2/325; B41J 2/355; B41J 2/365

[52] U.S. Cl. ..... 347/211; 347/171; 347/194; 347/193

[58] Field of Search ..... 347/171, 211, 347/194, 195, 193, 189; 400/120.16, 120.13, 120.15, 120.01

[56] References Cited

U.S. PATENT DOCUMENTS 5,208,607 5/1993 Ohashi et al. .

FOREIGN PATENT DOCUMENTS 0501707 9/1992 European Pat. Off. .

3144368 9/1982 Germany .

3613946 10/1986 Germany .

3641435 6/1987 Germany .

60-83864 5/1985 Japan .

*Primary Examiner*—Huan H. Tran

*Attorney, Agent, or Firm*—Thomas N. Ljungman

[57] ABSTRACT

The invention is directed to a thermal printer, with a thermal print head having a series of electrically drivable heating elements, with a microprocessor transferring data to be printed into a register associated with the thermal print head. In order to increase the printing speed, a buffer storage connected to the microprocessor via a parallel data line as well as a separate load state monitoring circuit are proposed, the monitoring circuit being connected to the buffer storage and causing data to be transferred from the buffer storage into the register when the data written into the buffer storage from the microprocessor has reached a defined quantity. As an alternative or addition, it is recommended to insert a pulse generator and a stepping motor driver between the output of the microprocessor and the stepping motor for driving the platen roll.

20 Claims, 9 Drawing Sheets

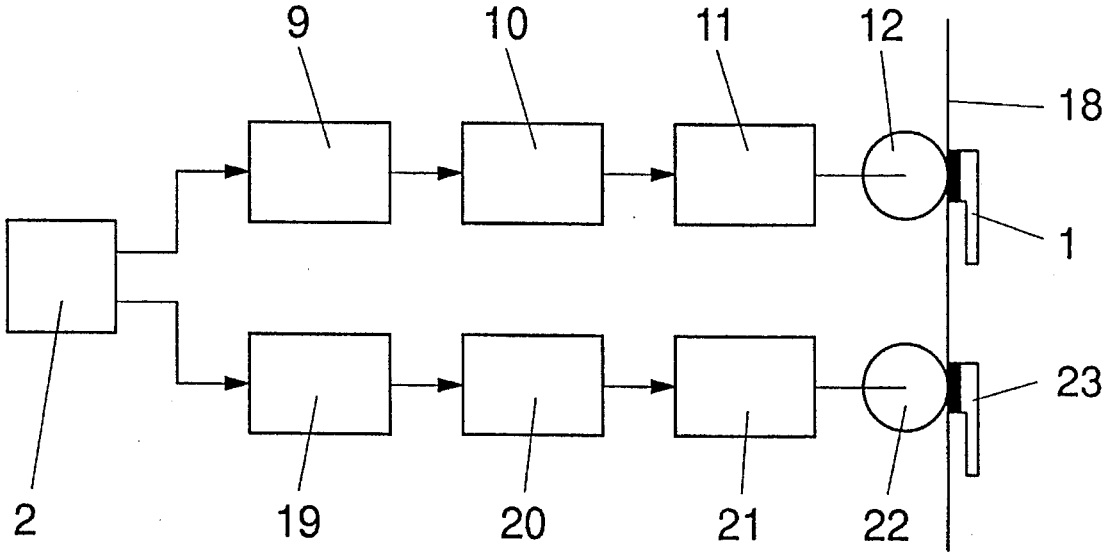
FIG. 2
FIG. 3
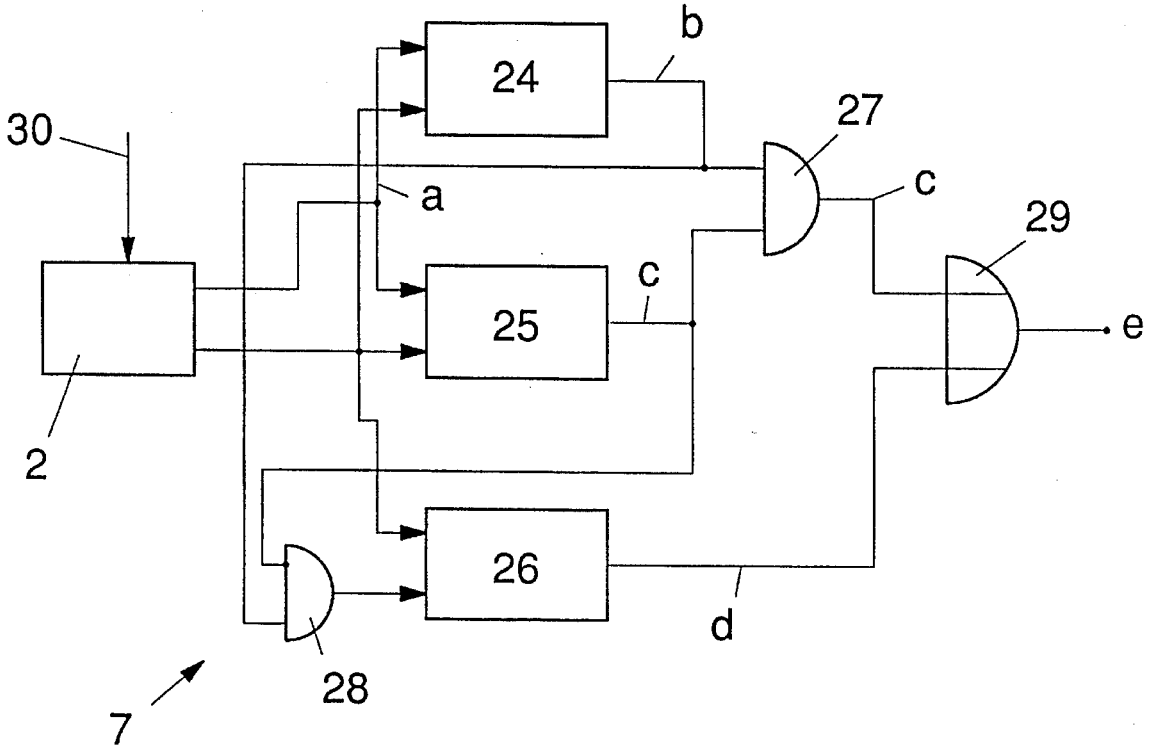

FIG. 18
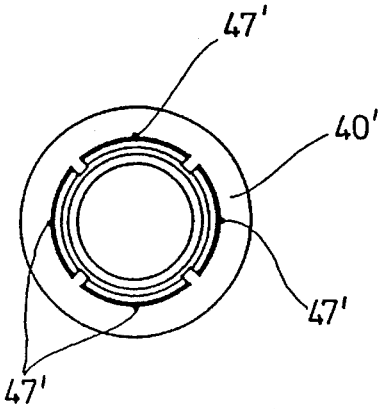
FIG. 14
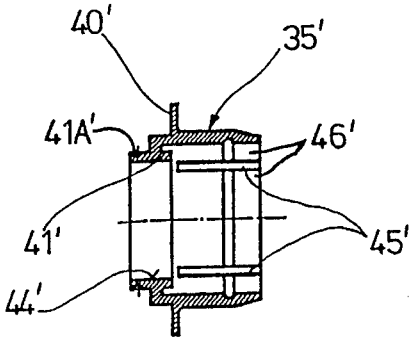
FIG. 15
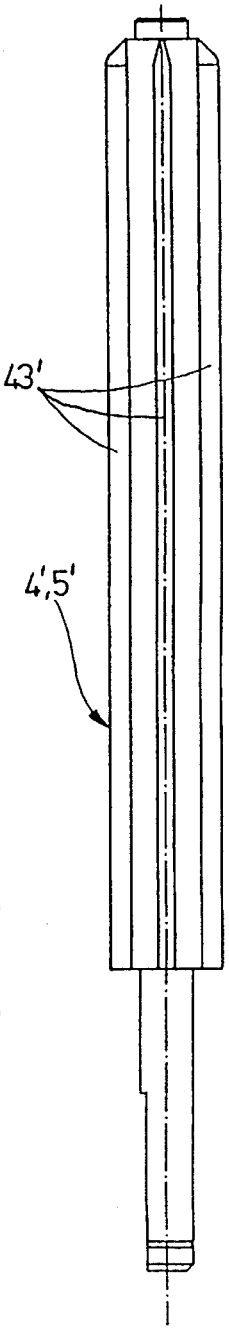
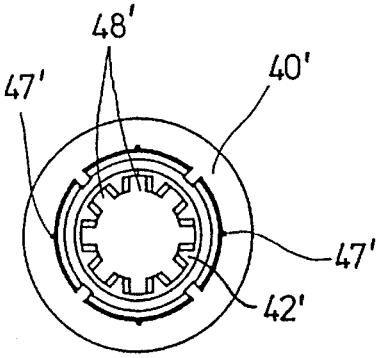
FIG.16
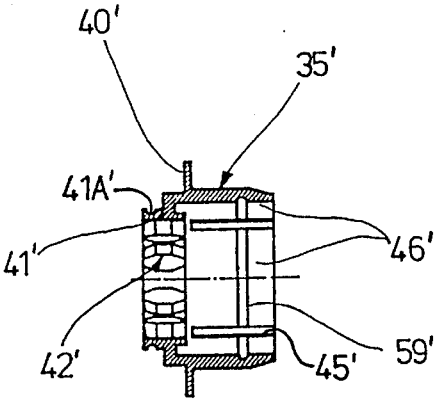
FIG. 17
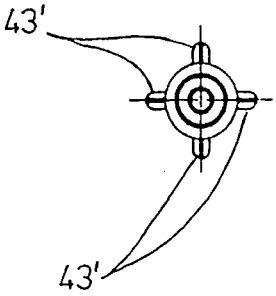
FIG. 19

THERMAL PRINTER

BACKGROUND OF THE INVENTION

1. Field of the Invention

This invention relates to a thermal printer, with a thermal print head having a series of electrically drivable heating elements, with a microprocessor transferring data to be printed into a register associated with the thermal print head and with driving driver circuits connected to the heating elements, the register receiving the data in serial form.

2. Background Information

In known thermal printers, thermal print heads are used which include a series of electrically selectively drivable heating elements. Between the heating elements and a platen roll, the recording medium to be printed upon and, if the recording medium is not thermally active, the effective part of a thermally activatable ribbon, are arranged so that a current flowing through the heating elements results in dyeing (as a rule, blackening) of the recording medium. As known, for example, from DE 36 13 946 A1 or EP 501 707 A2, the data to be printed is forwarded to the thermal print heads via a serial data line. Thus, data is transmitted via only one line from a microprocessor arranged on the mother board to the print head, paralleled there by means of a (shift) register, one register corresponding to one print line. The data is used for driving the driver circuits of the heating elements.

In such an arrangement, the high expenditure of time involved in transmitting data serially is generally to be regarded as a disadvantage. Considering that thermal print heads built to today's design mostly comprise more than 1,000 heating elements and just as many register elements, the time lag caused by changing the data to a serial form by means of the microprocessor and transmitting it sequentially can be rather significant. Because the microprocessor is not available for other tasks during this time lag, such as for arithmetic operations or for the control of the platen roll, the microprocessor has to execute such tasks after the time lag. As a result, the maximum printing speed can be substantially reduced.

Further, in printers, the stepping motor driving the platen roll can be controlled (as known, for example, from JP 60-83864 A) in such a way that a control circuit supplies pulses to a stepping motor, whenever the number of pulses tends to correspond to the respective feed of the recording medium. Because, for reasons of cost and for the purpose of avoiding synchronization problems, the same microprocessor tends to control, as a rule, both the data transmission to the print head and the stepping motor of the platen roll, software routines can be conventionally used. As a result, corresponding pulses can be issued to the stepping motor, while blocking the microprocessor for other tasks during the feeding cycle of the recording medium.

Likewise, such a software-based control of the stepping motor can result in the disadvantage of a considerably reduced printing speed.

OBJECT OF THE INVENTION

It is accordingly an object of the present invention to improve known control circuits in such a way that the efficiency of the microprocessor is enhanced and the realizable printing speed is increased.

SUMMARY OF THE INVENTION

Herebelow, essentially two alternative or jointly realizable proposals for accomplishing the above object will be described, one referring to the data transmission to the thermal print head, the other referring to the control of the stepping motor of the platen roll.

According to the present invention, the above object can be accomplished by a buffer storage connected to the microprocessor via a parallel data line, as well as by a separate load state monitoring circuit connected to the buffer storage, to cause data to be transferred from the buffer storage into the register when the data written into the buffer storage from the microprocessor has reached a defined or predetermined quantity.

Essentially, the thrust of the invention, in accordance with at least one preferred embodiment thereof, is to preferably relieve the microprocessor by means of an external storage and a load state monitoring circuit. Data is preferably read out of the microprocessor into the buffer storage in parallel at high speed and subsequently transferred into the register of the thermal print head sequentially in a conventional fashion, with the sequential transmission of the data to the register preferably being controlled by the separate load state monitoring circuit, rather than by the microprocessor. The load state monitoring circuit preferably monitors the level, or portion, of the storage containing the data to be printed, activating the transfer of data into the register of the print head as soon as a predetermined value is exceeded. As a rule, the capacity of the buffer storage can preferably correspond to that of the register of the thermal print head. An essentially decisive aspect herein can be that the microprocessor, following transmission of the data to the buffer storage, can be available for other tasks, such as for the control of the printer mechanism or for the calculation of data to be printed out (bit map), because the microprocessor is essentially no longer responsible for bringing the data in sequential order or for controlling the transmission.

Irrespective of the fact that physical conditions may essentially require that the transmission speed of the data to the register be maintained at a constant level, the present invention, in accordance with at least one preferred embodiment thereof, enables a substantial acceleration of the printing process to be achieved because of the relief that the load state monitoring circuit provides to the microprocessor.

Although it would be conceivable to start the transfer of data into the register after the write-in of a data volume necessary for driving the whole line of heating elements into the storage is completed (that is, equating that portion of the data transferred into the buffer storage at which the load state monitoring circuit starts transferring into the register, with a print line), it can be recommended to start read-out from the buffer storage after a smaller data volume (30%, for example) is written into it, rather than waiting until the data of the whole line is written. On the one hand, for reasons of economy, a control of this type makes it possible to select the capacity of the buffer storage at a level lower than that of the register of the thermal print head, and also to transmit the data of a print line successively in subsets from the microprocessor to the register via the buffer storage. On the other hand, in a procedure according to a preferred embodiment of the present invention, a control of the type just described enables data to be written into the register concurrently with the transmission of data from the microprocessor to the buffer storage. The advantageous result resides in time savings realized by the simultaneous data transmission operations, allowing a higher printing speed.

Another possibility within the scope of the present invention is to control the microprocessor in such a way that the microprocessor will preferably stop feeding data to the buffer storage after data of one print line is transmitted, so that the microprocessor attends instead to the other above-mentioned tasks (such as the control of the printing mechanism or the calculation of the subsequent print line), and that, after at least part (or all) of the data is transmitted from the buffer storage to the register, the microprocessor will preferably start writing the data corresponding to the next print line into the buffer storage. Accordingly, there is the possibility of substantially completely decoupling the register from the microprocessor and concurrently reading out the data of one print line from the buffer storage, while at the same time transmitting the subsequent line to the buffer storage as soon as free capacity becomes available therein.

As a buffer, a storage known under the designation "first-in-first-out" storage can preferably be considered for use because it can enable the data to be transmitted in the appropriate sequence, the first data stored being the first data transferred into the register. A parallel-to-serial converter can preferably be connected to the buffer storage via a data bus in such a manner that one data word each of the same (first) storage area can be read out. The microprocessor can preferably write the data of the first data word to be output (comprising, for example, 16 bits) into this storage area. At the same time, an (initially reset) counting pointer can preferably be incremented by a pulse present at the write output of the microprocessor. By means of the counting pointer, the subsequent data words can preferably be written into the subsequent storage areas, the counting pointer preferably being incremented by one after each write-in operation of a data word (of 16 bits, for example). Thus, the buffer storage can preferably be loaded in successive sequence. The load state monitoring circuit can preferably recognize the storage load by means of the counting pointer, activating the transmission of data to the parallel-to-serial converter when a defined quantity is reached. The data of the first storage area is then preferably read out. In addition, after a data word is read out, the counting pointer is preferably decremented, and the data of the subsequent storage areas can preferably be copied word by word into the preceding storage area. The buffer storage can thus preferably be dynamically managed in the manner of a queue (first-in-first-out). Of course, it is also possible to enter the data from the microprocessor invariably into the same storage area, shift it successively forward and determine the address of the respective storage area that has been read out by means of the counting pointer.

Modern thermal print heads as described, for example, in EP 501 707 A2, can tend to have an input for a print release signal suitable for activating the heating elements. As the latter have a much reduced service life when in continuous use, it can prove necessary to chop the print release signal, that is, compose the signal of individual pulses. In a concrete sense, a print release signal comprising an initial continuous pulse with rectangular pulses following, can be advantageous and thus customary. The duration of pulses and pulse spaces can define the heating energy and thus the temperature of the heating elements.

In order to relieve the microprocessor of the need to generate the print release signals, which task can be performed, in known arrangements, by software routines, requiring a corresponding expenditure of time, it is proposed herein to provide the respective output of the microprocessor and/or the load state monitoring circuit with a circuit generating the desired pulses. Thus, essentially all the microprocessor is required to do is supply a pulse for activation of the circuit, so it is immediately available again for other tasks while the circuit is busy generating the print release signal.

As a rule, the microprocessor will tend to transmit to the circuit data indicative of the duration of the pulses and pulse spaces before the output of a print page. On the one hand, a sufficiently frequent adaptation to the current print parameters is thereby possible, and, on the other hand, the time required for updating can be kept within limits. The print release signal can be activated by the microprocessor and/or the load state monitoring circuit. It is to be noted that, apart from considering the print release signal, the print head can also generally consider the previous print data and the data of the adjacent heating elements (referred to as the "dot history") in the calculation of the energy to be supplied to the heating elements.

Moreover, it is suggested to preferably provide the thermal print head with a temperature sensor and to preferably connect the latter to an input of the microprocessor, the microprocessor then being in a position to use the temperature of the print head to control the circuit for generating the print release signal by varying the duration of the pulses and/or pulse spaces in such a way that the maximum permissible temperature of the print head is not exceeded. Accordingly, on the other hand, optimum print results can be obtained.

As an addition or alternative to the above, the print release signal may be varied by the microprocessor in such a way as to accomplish an optimum adaptation of the temperature of the heating elements to the printing speed and/or the type of paper to be printed upon.

As another alternative in accordance with the present invention, in a control circuit for a printing machine with a print head adapted to be moved into contact with a platen roll driven by a stepping motor, with a microprocessor including an output connected to the stepping motor, the problems underlying the present invention can be solved by inserting a pulse generator and a stepping motor driver which are connected between the output of the microprocessor and the stepping motor.

Rather than generating the control pulses of the stepping motor by suitably programming the microprocessor, as may be customary in accordance with known arrangements, the basic idea, in accordance with at least one preferred embodiment of the present invention, is to have these pulses preferably produced by hardware using a separate pulse generator. Its output signals are preferably amplified in a stepping motor driver and finally delivered to the stepping motor.

It is thus possible to relieve the microprocessor of the task of controlling the stepping motor, so that all that it is essentially required to do is to activate the pulse generator to perform a paper feed. After this, the microprocessor can be available for other tasks, which enables the printing speed to be increased because microprocessor-related idle times can essentially be avoided.

Multi-color printing can be realized with particular ease if the microprocessor controls at least one further thermal print head in addition to driving, via at least one further pulse generator and at least one further stepping motor driver and stepping motor, and one further platen roll. Preferably, a respective one of the thermal print heads rests against each platen roll. Because the diameters of platen rolls can mostly tend to slightly differ, it can be necessary to drive them at different rotational frequencies. While problems are anticipated in a conventional software-based control when the pulses of two stepping motors can differ in time due to sequential programming while being required to coincide, a control of the type in accordance with at least one preferred embodiment of the present invention can be implemented, essentially without any problems because each stepping motor can preferably be driven by a pulse generator of its own.

It should be understood that when the word "invention" is used in this application, the word "invention" includes "inventions," that is, the plural of "invention." By stating "invention," applicant does not in any way admit that the present application does not include more than one patentably and non-obviously distinct invention, and maintains the possibility that this application may include more than one patentably and non-obviously distinct invention. The applicant hereby asserts that the disclosure of this application may include more than one invention, and, in the event that there is more than one invention, that these inventions may be patentable and non-obvious, one with respect to the other.

One aspect of the invention resides broadly in a thermal printer for printing an image on a carrier, the printer comprising: a housing; apparatus for printing an image onto a carrier; the printing apparatus being disposed at the housing; apparatus for permitting movement of the carrier to the printing apparatus and away from the printing apparatus; a microprocessor; the microprocessor comprising an arrangement for converting input data from an input source into image data; an arrangement for storing and buffering image data; the buffer storage arrangement comprising an arrangement for storing image data received from the microprocessor; apparatus for transmitting image data from the microprocessor to the buffer storage arrangement; the buffer storage comprising an arrangement for transmitting image data upon a first predetermined condition being met; a register; the register comprising an arrangement for storing image data received from the buffer storage arrangement; arrangement for transmitting image data from the buffer storage arrangement to the register; the printing means comprising a print head apparatus; the print head apparatus comprising at least one printing element; an arrangement for transmitting image data from the register to the print head; an arrangement for activating the at least one printing element to permit the printing of image data onto a carrier by the at least one printing element.

Another aspect of the invention resides broadly in a thermal printer for printing an image on a carrier, said printer comprising: a housing; apparatus for printing an image onto a carrier; the printing apparatus being disposed at the housing; apparatus for permitting movement of the carrier to the printing apparatus and away from the printing apparatus; circuitry for receiving input data from an input source and transforming the input data into image data to be printed onto a carrier; the circuitry comprising: a microprocessor; the microprocessor comprising an arrangement for converting input data from an input source into image data; an arrangement for storing and buffering image data; the buffer storage arrangement comprising an arrangement for storing image data received from the microprocessor; arrangement for transmitting image data from the microprocessor to the buffer storage arrangement; the buffer storage comprising an arrangement for transmitting image data upon a first predetermined condition being met; a register; the register comprising an arrangement for storing image data received from the buffer storage arrangement; arrangement for transmitting image data from the buffer storage apparatus to the register; the printing apparatus comprising a print head arrangement; the print head arrangement comprising at least one printing element; arrangement for transmitting image data from the register to the print head; arrangement for activating the at least one printing element to permit the printing of image data onto a carrier by the at least one printing element.

Yet another aspect of the invention resides broadly in a method of operating a thermal printer for printing an image on a carrier, the printer comprising: a housing; apparatus for printing an image onto a carrier; the printing apparatus being disposed at the housing; apparatus for permitting movement of the carrier to the printing apparatus and away from the printing apparatus; a microprocessor; the microprocessor comprising an arrangement for converting input data from an input source into image data; arrangement for storing and buffering image data; the buffer storage arrangement comprising an arrangement for storing image data received from the microprocessor; arrangement for transmitting image data from the microprocessor to the buffer storage arrangement; the buffer storage comprising an arrangement for transmitting image data upon a first predetermined condition being met; a register; the register comprising an arrangement for storing image data received from the buffer storage arrangement; arrangement for transmitting image data from the buffer storage arrangement to the register; the printing apparatus comprising a print head apparatus; the print head apparatus comprising at least one printing element; arrangement for transmitting image data from the register to the print head; arrangement for activating the at least one printing element to permit the printing of image data onto a carrier by the at least one printing element; the method comprising the steps of: providing the housing; providing the printing apparatus; providing the carrier; printing an image onto the carrier with the printing apparatus; disposing of the printing apparatus at the housing; providing the moving apparatus; moving the carrier to the printing apparatus and away from the printing apparatus; providing the microprocessor; providing an arrangement for converting input data to image data; providing an arrangement for storing and buffering image data; providing an arrangement for transmitting image data from the microprocessor to the buffer storage arrangement; providing an arrangement for transmitting image data from the buffer storage arrangement upon a first predetermined condition being met; providing a register; providing the register arrangement for storing image data received from the buffer storage arrangement; providing an arrangement for transmitting image data from the buffer storage arrangement to the register; providing a print head apparatus; providing the print head apparatus with at least one printing element; providing an arrangement for transmitting image data from the register to the print head apparatus; providing an arrangement for activating at least one printing element to permit the printing of an image onto a carrier; the method further comprising the steps of: inputting data into an input source; transmitting the input data to the microprocessor; converting the input data into image data; transmitting image data from the microprocessor to the buffer storage arrangement; storing and buffering the image data in the buffer storage arrangement until a first predetermined condition is met; transmitting the image data from the buffer storage arrangement to the register; transmitting the image data from the register to the print head apparatus; activating at least one printing element to permit the printing of an image onto a carrier.

BRIEF DESCRIPTION OF THE DRAWINGS

Embodiments of the present invention will be described in more detail herebelow with reference to the accompanying drawings, wherein:

FIG. 2 schematically illustrates a drive of the platen rolls advantageous for multi-color printing;

FIG. 3 schematically illustrates a circuit for the generation of the print release signal;

FIG. 14 is a plan view on an enlarged scale of the base of one of two cores;

FIG. 15 is a longitudinal center section through the base body of FIG. 14;

FIG. 16 is a plan view of the other base body of the cores;

FIG. 17 is a longitudinal center section through the base body illustrated in FIG. 16;

FIG. 18 is a plan view of the drive shaft corresponding to the cores; and

FIG. 19 is a plan view of the drive shaft illustrated in FIG. 18, from the right.

DESCRIPTION OF THE PREFERRED EMBODIMENT

Figure 1:
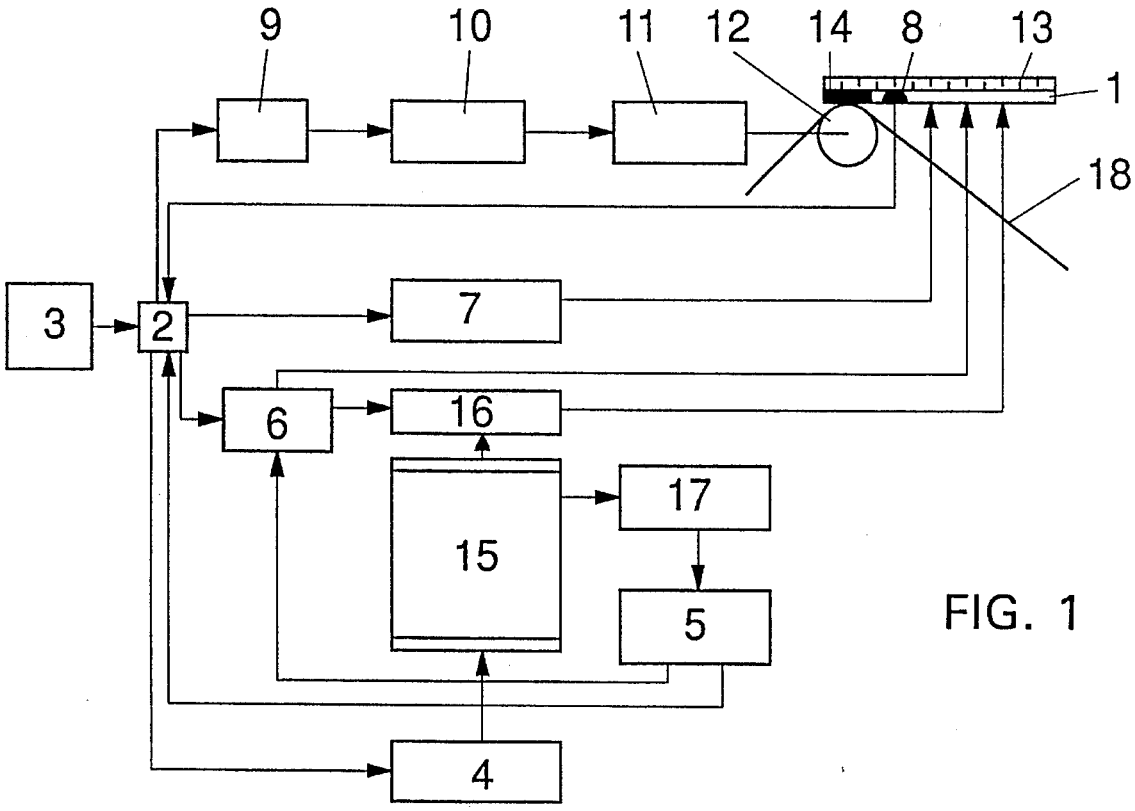
FIG. 1 schematically illustrates a control circuit for a thermal print head.

The control circuit for a thermal print head 1 illustrated in FIG. 1 preferably includes a microprocessor 2 to which a control keyboard 3 is preferably connected as a data input facility. The microprocessor 2 is preferably connected to a data input interface 4, a read/write control circuit 5, a first pulse generator 6, a circuit 7 for generating a print release signal, and a temperature sensor 8 for sensing the temperature of the thermal print head 1. The microprocessor 2 further preferably drives a second pulse generator 9 connected, via a stepping motor driver 10, to a stepping motor 11 for driving the platen roll 12.

Indicated in rough outline in the thermal print head 1 is a register 13 preferably having as many storage cells as the thermal print head 1 has heating elements 14. The present embodiment may provide, for example, a thermal print head 1 having 1,280 heating elements 14 and 1,280 register elements 13.

The core of the control circuit is preferably formed by a buffer storage 15 comprising, for example, 80 storage elements each of 16 bits. The data to be printed is preferably read into the register 13 of the thermal print head via a parallel-to-serial converter 16 connected to the buffer storage 15. The clock pulses of the pulse generator 6 are preferably directly fed to the thermal print head 1. Moreover, the storage contents of the buffer storage 15 are preferably monitored by a load state monitoring circuit 17.

When, under the control of the keyboard 3, the microprocessor 2 can be caused to read data into the buffer storage 15 via the data input interface 4, the load state monitoring circuit 17 will check how much storage space is occupied in the buffer storage 15. If a designated portion of, for example 30%, is already occupied, the load state monitoring circuit 17 will preferably cause the read/write control circuit 5 to read data into the parallel-to-serial converter 16 and to write it into the register 13, clocked by the first pulse generator 6. Parallel to this operation, data will preferably continue to be read into the buffer storage 15 under the control of the read/write control circuit 5.

When the register 13 of the thermal print head 1 is full, the microprocessor 2 will preferably cause the circuit 7 to send a print release signal to the thermal print head 1, causing printing of the stored data onto a recording medium 18. Parallel thereto, the microprocessor 2 will preferably start the second pulse generator 9 which then activates automatically, via the stepping motor driver 10, the stepping motor 11 which drives the platen roll 12 for feeding the recording medium 18.

Figure 1A:
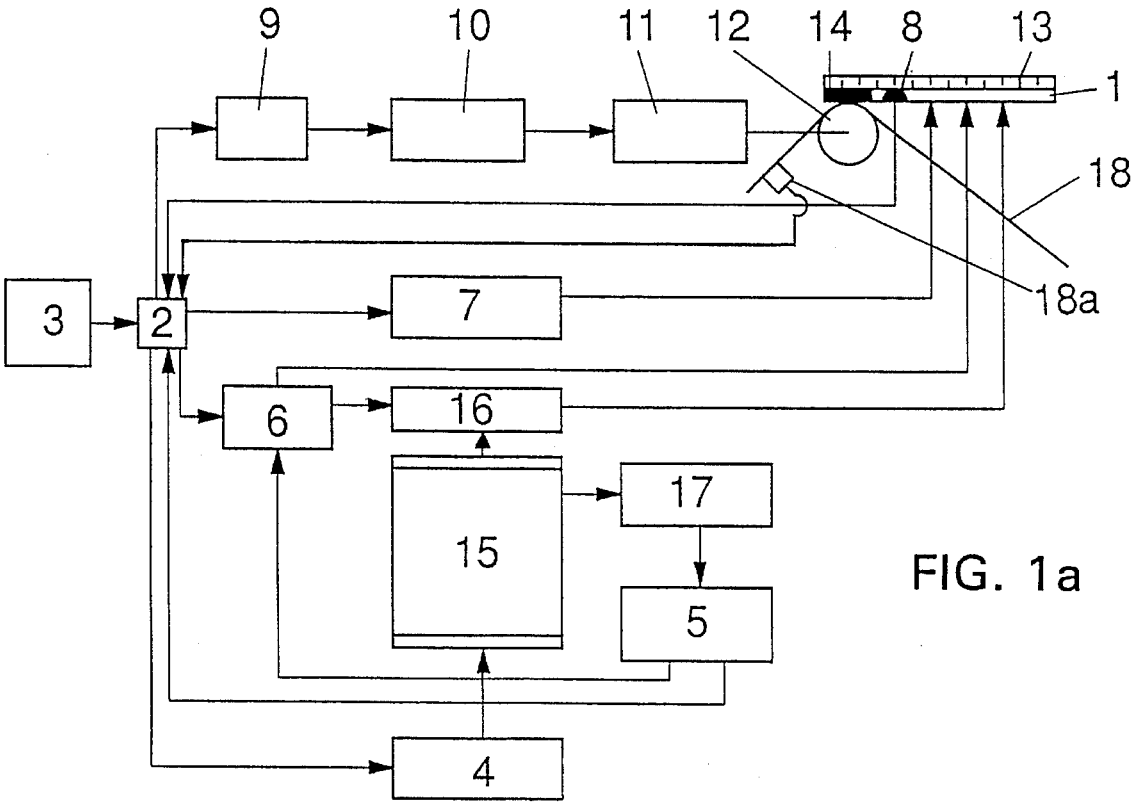
FIG. 1*a* schematically illustrates a further embodiment of the control circuit shown in FIG. 1.

FIG. 1*a* shows a further embodiment of FIG. 1 with the addition of a sensor 18*a* for determining the type of recording medium 18 used for printing.

FIG. 2 preferably indicates in schematic outline a multicolor thermal printer comprising, in addition to the microprocessor 2, the second pulse generator 9, the stepping motor driver 10, the stepping motor 11, the platen roll 12 and the thermal print head 1, a further pulse generator 19, a further stepping motor driver 20, a further stepping motor 21, a further platen roll 22 and a further thermal print head 23. In the present embodiment, the temperature-sensitive recording medium 18 may respond to temperature variations with different colors. Thus, multi-color printing can be accomplished by heating the heating elements 14 of the two thermal print heads 1, 23 to different temperatures, printing upon the recording medium 18 being then performed in successive sequence. The advantage of an arrangement of this type is that the two platen rolls 12,22 are preferably driven independently of each other, after the pulse generators 9, 19 have been started by the microprocessor 2. Thus, manufacturing tolerances of the platen rolls 12, 22 can be compensated for without the recording medium 18 tearing or forming loops.

FIG. 3 preferably shows the circuit 7 for generating the print release signal. It can be controlled by the microprocessor 2 and comprised of a first 24 a second 25 and a third 26 rectangular pulse generator. The output of the first rectangular pulse generator 24 is connected to the non-inverting inputs of a first 27 and a second 28 AND-element, while the output of the second rectangular pulse generator 25 is connected to the non-inverting input of the first AND-element 27 and the second AND-element 28. The outputs of the first AND-element 27 and of the third rectangular pulse generator 26 are connected to the inputs of an OR-element 29 delivering the print release signal via its output.

Figure 4:
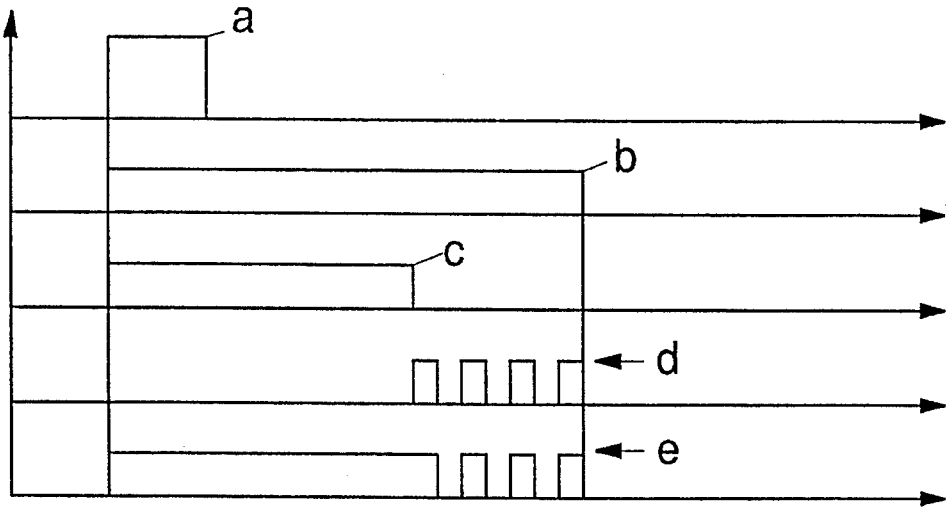
FIG. 4 schematically illustrates a pulse diagram of the circuit illustrated in FIG. 3.

The pulse diagram indicated schematically in FIG. 4 preferably illustrates the function of the circuit 7. First, the microprocessor 2 preferably delivers a start signal a to the first 24 and to the second 25 rectangular pulse generator, the signal causing the first rectangular pulse generator 24 to deliver a pulse b and causing the second rectangular pulse generator 25 to generate a pulse c. Both pulses b and c are applied to the first AND-element 27, pulse c thus being present at its output. Further, both pulses b and c are fed to the second AND-element 28 generating the signal b AND NOT c and delivering it to the third rectangular pulse generator 26. As the third rectangular pulse generator 26 is driven by this signal b AND NOT c, it will generate the signal d which, in combination with the signal c, will preferably produce the print release signal e following an OR-operation in the OR-element 29.

Via line 30 shown in FIG. 3, the microprocessor can be driven by the temperature sensor 8 located in the thermal print head. This causes the microprocessor 2 to preferably vary the duration of pulse c in the second rectangular pulse generator 25 and the pulse duty factor of the third signal d generated by the rectangular pulse generator in such a way that the temperature of the thermal print head 1 assumes an optimum, non-critical value.

Figure 5:
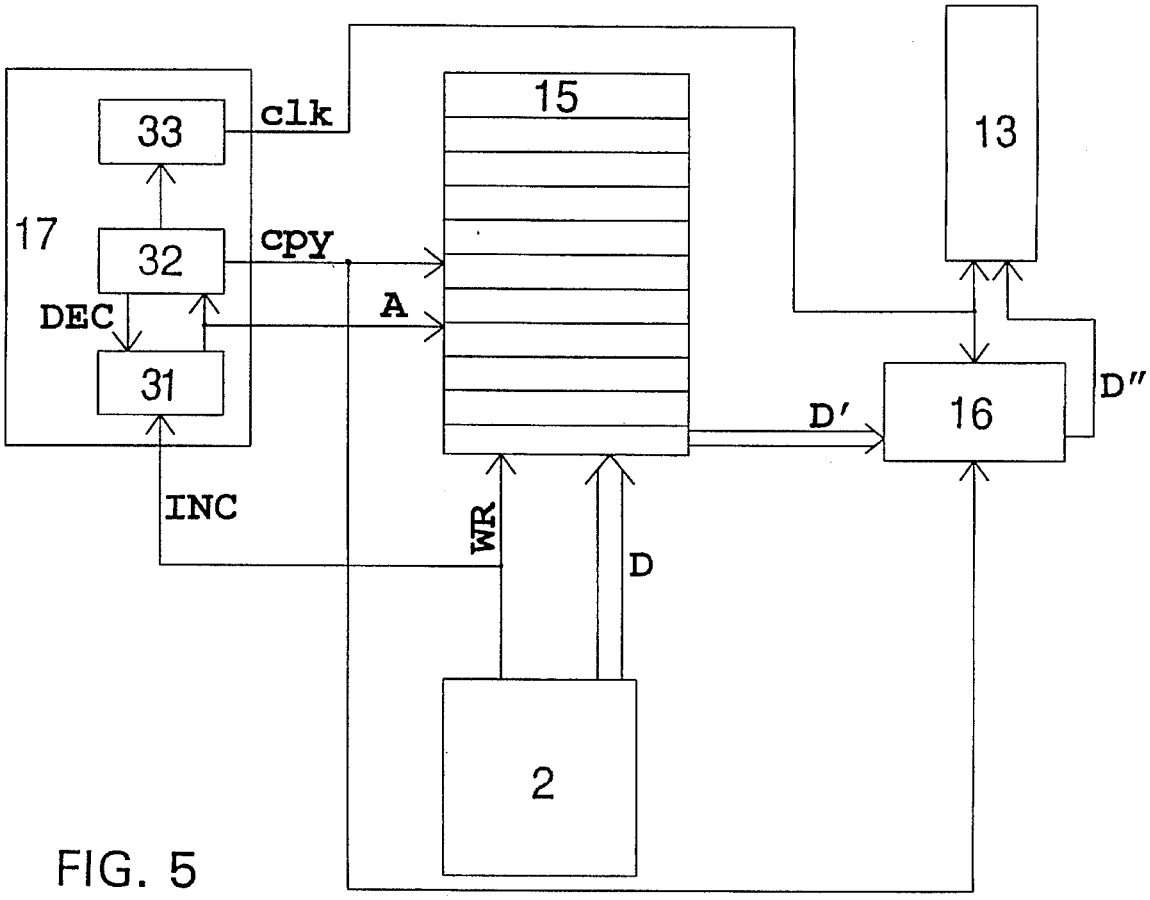
FIG. 5 schematically illustrates a load state monitoring circuit.

Finally, FIG. 5 preferably shows the internal structure of a load state monitoring circuit 17 and its connection to the remaining control circuit. In this Figure, the data bus D of the microprocessor 2 is directly connected to the buffer storage 15. The microprocessor write output WR which is in the "1" condition during the output of data only is connected to both the buffer storage 15 and a counting pointer 31 of the load state monitoring circuit 17. During each write operation from the microprocessor 2 into the buffer storage 15, the output A of the counting pointer 31 is increased by one (incremented), its respective input being therefore identified by INC in the Figure. At the beginning, with the storages reset, the data words of the microprocessor 2 can be entered into the lower storage area of the buffer storage 15 when viewing the Figure. As soon as the output A of the counting pointer 31 is incremented, the subsequent data can be entered into the address of the buffer storage 15 corresponding to its output A and following the lowermost storage cell, the buffer storage being thus successively loaded from the bottom to the top.

The transfer of data from the buffer storage 15 into the parallel-to-serial converter 16 and into the register 13 of the thermal print head 1 can be performed under hardware control 32. As soon as the output A of the counting pointer 31 reaches a predetermined number (corresponding to the defined quantity of data at which the read-out operation into the print head 1 is required to start), a pulse will preferably be present at the output (cpy) of the hardware control circuit 32, this pulse representing a copy demand to the effect that, for one thing, the data word D' of the lowermost storage cell of the buffer storage 15 is transmitted to the parallel-to-serial converter 16 and onwards, in serial form D", to the register 13, while a the same time the data words of all other storage cells of the buffer storage 15 are shifted down by one storage cell each, the output (cpy) being therefore connected to the buffer storage 15 and to the parallel-to-serial converter 16. The contents of the buffer storage 15 are thus preferably successively read out into the register 13. As each data word is being read out, a pulse can be at the same time applied to the input DEC of the counting pointer 31 which subtracts the quantity 1 from its output A (decrementing). If a write operation is then executed by the microprocessor 2, the next lower storage cell will thus preferably be loaded with data—one storage cell having become available. The hardware control circuit 32 further activates a timer 33 at the output (clk) of which rectangular signals are present when reading out data, these signals serving as clock pulses for the parallel-to-serial converter 16 and the register 13.

It can be necessary to synchronize the hardware control circuit 32 in order to avoid an incrementing and a decrementing signal being present at the counting pointer 31 at the same time (if the microprocessor 2 and the buffer storage 15 issue data concurrently), and causing data to be entered into an incorrect address of the buffer storage 15. Synchronization may be accomplished in such a way that the hardware control circuit 32 suppresses the decrementing command DEC as long as the write output WR of the microprocessor 2 is in the "1" condition. Upon completion of the write operation of the microprocessor 2, the decrementing command DEC (and the copying operation in which the data words of all storage cells of the buffer storage 15 are shifted down by one storage cell each) is made up so that the output A of the pointing counter 31 is updated prior to the next write operation. The two operations being related to different addresses, it is thus possible to read data into the buffer storage 15 while at the same time reading it out.

As a result, a control circuit for a printing machine can preferably be obtained which is characterized by high efficiency and printing speed.

Figure 6:
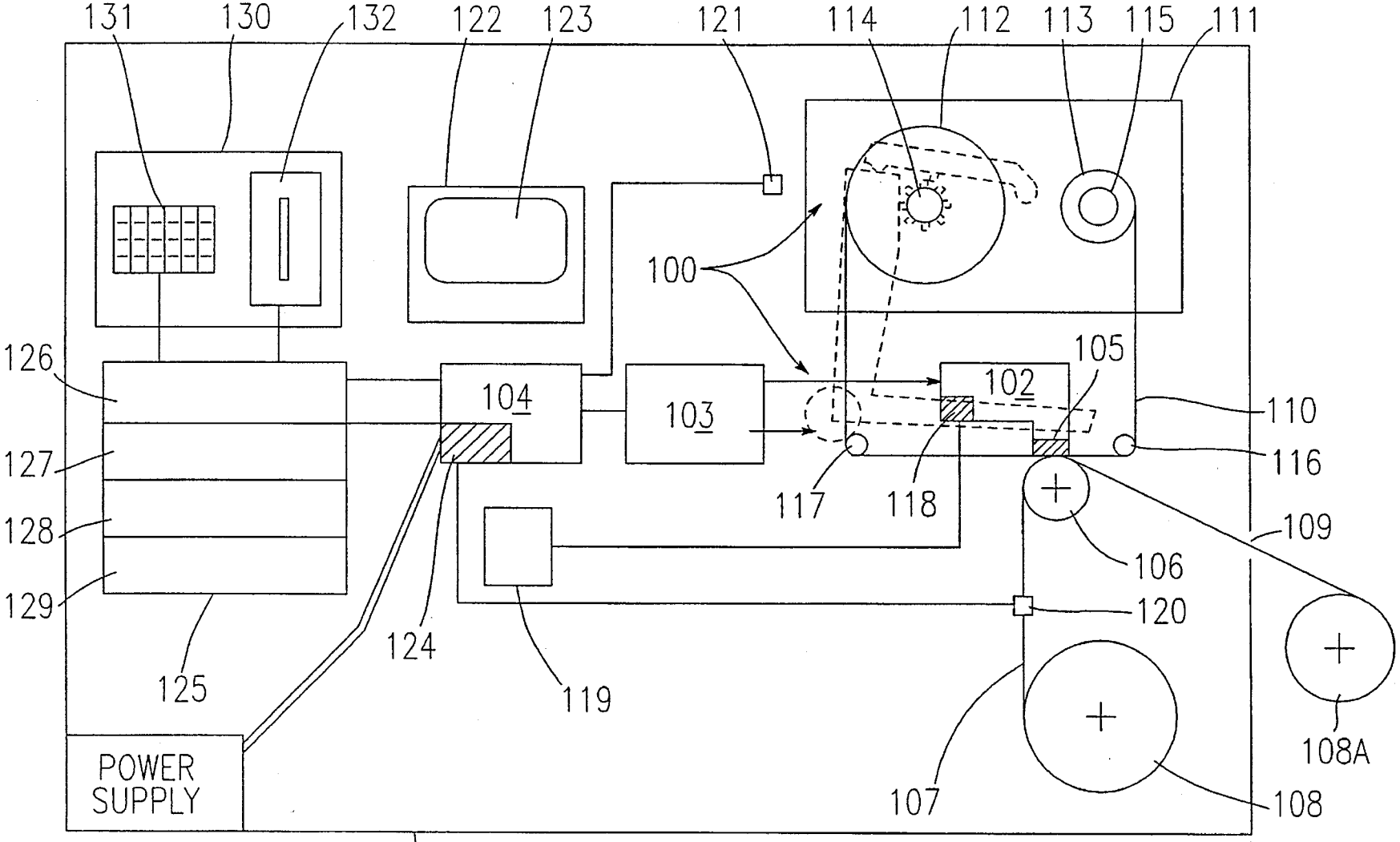
FIG. 6 schematically illustrates a general embodiment of a thermal printer.

One type of thermal printer which could be configured with the stopping and lifting arrangement in accordance with the present invention is depicted in FIG. 6. In FIG. 6, the stopping and lifting arrangement is schematically represented by the reference number 100. The thermal printer 101 has a thermal print head 102 which can be electrically connected by means of a control circuit 103 to a computer processor 104. On the underside of the thermal print head 102 there are preferably electrically activated heating elements 105, which can be maintained in contact against a counterpressure roller 106. Preferably, the heating elements 105 can be oriented in a straight line lying perpendicular to the plane of the drawing and aligned with a longitudinal axis of the counterpressure roller 106.

A label strip 107 can be introduced between the heating elements 105 and the counterpressure roller 106. As the label strip 107 is printed, it is preferably unrolled by means of a label strip payoff reel 108, and can, if desired be taken up by a take-up reel 108A. After having been printed with the desired printing information, the label strip 107 can be output by means of an outlet opening 109 of the thermal printer 101. The above described thermal printer apparatus 101, including the print head 102, the heating elements 105 and the label strips 107, are generally known in the art and are not described in great detail herein.

The label strip 107 can consist of temperature-sensitive paper which is printed as it is moved past the pin-shaped heating elements 105. Appropriate ones of the heating elements 105 can be heated as necessary, and the areas of the paper, or label strip 107, to which heat is applied can thereby be darkened at the desired points. Alternatively, the label strip 107 can also be conventional writing paper. With such conventional writing paper, it is generally necessary to introduce a thermal transfer ink ribbon 110 between the label strip 107 and the heating elements 105 of the thermal print head 102. The thermal transfer ink ribbon 110 can essentially be coated with temperature sensitive ink, which can preferably be configured to melt at the points where it is moved past activated, or heated, heating elements 105. The melted ink then can adhere to the conventional label strip 107 to thereby form a desired printed image.

Such a thermal transfer ink ribbon 110 can preferably be housed in a cassette 111, which cassette 111 can preferably have a payoff reel 112 and a take-up reel 113 therein. The cassette 111 can generally be positioned within the thermal printer 101 by means of devices 114, 115 which are configured to fit into, or hold the reels 112, 113. The thermal printer 101 can also preferably have deflector rollers 116, and 117 disposed within the printer housing, to direct the path of the ink transfer ribbon past the print head 102 and heating elements 105. Such deflector rollers 116, 117 essentially make certain that the thermal transfer ink ribbon 110 is moved past the heating elements 105 at the optimum angle for transferring the ink to the paper, or label strip 107, in which the ribbon 110 is in contact at the print head 105. Such thermal transfer ink ribbons, and the manner of transferring the ink thereon, are also considered to be well known in the art. One type of cassette which could be used in conjunction with the present invention is discussed further herebelow with reference to FIGS. 7–19.

The thermal print head 102 can be equipped with a temperature sensor 118 to transmit an analog electrical signal corresponding to the temperature of the thermal print head 102 to an analog-digital (A-D) converter 119. This A-D converter can then digitize the temperature signal and transmit the digitized signal to the processor 104.

The processor 104 can also preferably be connected to a paper sensor 120, which can be, for example, a photoelectric cell which detects the presence of a label strip 107, and reports the presence or absence of a strip to the processor 104. Alternatively, the paper sensor 120 can also be configured as a laser scanner which is capable of reading bar codes. If such a scanner were to be used, bar code markings, indicative of the type of paper being used, could be provided on the paper strips. The bar code markings on the label strip 107 could then be automatically read by the scanner to provide the processor 104 with information not only about the presence of the label strip material, but also about the type of label strip material present. These data can be retrieved by the processor 104 for further processing.

The processor 104 can also preferably be electrically connected to an ink ribbon sensor 121. This ink ribbon sensor 121 can be designed either as a photoelectric cell, only to detect the presence of the thermaltransfer ink ribbon 110, or, as discussed above for the paper sensor, can be designed as a laser scanner which can read the bar codes applied to the cassette 111, to thereby provide information on the material, or type of thermal transfer ink ribbon 110 being used. Photoelectric cells and laser scanners are essentially well known, and are therefore not described in any further detail herein.

Other types of sensors or scanners, within the skill of the artisan could also be used for detecting the paper or ink ribbon, or alternately scanning information provided on the paper or ink ribbon.

In order to make the thermal printer more "user-friendly", the processor 104 can preferably be connected to an optical data output medium 122. Such an output device 122 could provide an LCD screen 123 for displaying variables which the operator may have to adjust, or to alternately display control commands for operation of the printer. Various alternative output devices would also be within the skill of the artisan.

The processor 104 can also preferably be equipped with a working memory 124, the capacity of which is preferably sufficient to buffer the control data supplied both by a read/write memory 125 connected to the processor 104, and also by the paper sensor 120 and by the ink ribbon sensor 121 during a printing process. The processor 104 can preferably use this information to control the label printer 101. With such a buffer, or working memory 124, the processor could essentially operate at higher speeds as data transfer between the read/write memory 125 and the processor 104 would not need to continuously take place.

The read/write memory 125 can essentially be partitioned into several areas depending on the features of the thermal printer. The example shown in FIG. 6 essentially depicts four memory areas 126 to 129, but more or less could be provided, with the possibility for future expansion as needed. The memory areas could be set up as provided below, but the following is meant as an example only, and various other set-ups would be well within the skill of the artisan.

A first memory area 126, could be used to store the information which is to be applied, or printed on the labels. A second memory area 127 could be used to store a data matrix corresponding to the various types of paper which are usable for the label strips 107. A third memory 128 could be used to store the printing speed, that can be set or selected by the operator, and a fourth memory area 129 could be used to store the ink ribbon data corresponding to the various types of paper of the specified label strip 107.

The number of data matrices stored in the second memory area 127 should preferably correspond to the number of types of paper of the label strips 107 which are specified for use on the particular printer. Each of these data matrices is indicative of the type of paper it describes, and can, for example, consist of an array of three rows of delta, whereby the data in the first row could indicate the thermal print head temperatures, the data in the second row could indicate the printing speeds, and the data in the third row could indicate reference energy values. During printing, these reference energy values can be transmitted by the processor 104 preferably directly to the control circuit 103 to control the thermal energies; to be generated by the thermal print head 102 in each of the individual heating elements 105 to thereby produce an optimized print. For each data pair consisting of a thermal print head temperature and a printing speed, there is preferably a corresponding reference energy value for the paper being printed upon. Thus, when a temperature and a speed value are input, a reference energy value can clearly be determined and output.

The ink ribbon data contained in the fourth memory area 129 could essentially be described as a list consisting of three rows. The data in the first row could indicate the type of paper of the label strip 107 to be used. The data in the second row could have the values 0 and 1, whereby a "0" can mean that when the type of paper listed in the first row is being used for printing, no thermal transfer ink ribbon is necessary, and a "1" could indicate that an ink ribbon is necessary for printing. In the third row, there can either be a "0", which can indicate that when a particular type of paper is used, no special requirements need to be set for the material of the thermal transfer ink ribbon 10, or another digit, i.e., 1, 2, 3, etc. could indicate which type of ink ribbon must be used to print the specific type of paper.

The above described data arrays can preferably be read into the read/write memory 125 by means of a data input device 130. Such an input device 130 could essentially be a computer keyboard 131 and a card reader device 132, or in essence could essentially be any type of input mechanism which are commonly used for entering data values into computers, i.e. a scanner.

During the installation of the thermal printer, the data matrices corresponding to the types of paper to be used can be read into the corresponding memory area, or in this example, the second memory area 127. Likewise, the ink ribbon data can be read into its corresponding memory area, or the fourth memory area 129 of the read/write memory 125. Then, when printing is to be done, the data to be printed on the label strip 107 can be input into its corresponding memory area, or the first memory area 126 by means of the input device 130, or computer keyboard 131 and the card reader 132.

The processor 104, via the LCD screen 123, can then preferably output a list of the types of paper that were read into the second memory area 127. The operator can then manually select the data matrix corresponding to the type of paper to be used. Further, the printer may also be set up so that the operator is given an opportunity to verify whether there is a data matrix already stored for the particular type of paper of the label strip 107. Thus, if necessary, the appropriate data matrix can then be read into the corresponding memory area, or second memory area 127 of the read/write memory 125. Alternatively, a label strip 107 of a paper with a data matrix already stored in the memory and displayed on the LCD screen 123 can be introduced into the thermal printer 101.

The processor 104 can then retrieve the data matrix corresponding to the type of paper selected, and can call up the corresponding ink ribbon data from the read/write memory 125, and store these data in its working memory 124.

By means of the LCD screen 123, the processor 104 can output a list of the possible printing speeds contained in the data matrix, and thus enable the operator to select a desired printing speed. If the operator does not select a speed, the processor can automatically default to a predetermined printer speed, which can be, for example, the maximum possible printing speed of the printer. Alternately, if it is known that operation at the maximum speed is not desired, alternative default speeds, such as 50% or 75% of the maximum speed could be entered as the default speed if so desired.

The above described thermal printer 101, thereby provides an opportunity at the beginning of the printing process to select a printing speed, which printing speed can then be stored in the third memory area 128 of the read/write memory 125. After the selected data matrix has been read into the working memory 124, the processor 104 can preferably retrieve the value corresponding to the desired printing speed from the third memory area 128, and compare this value to the speed values contained in the data matrix. The processor 104 can then preferably automatically select the value from the data matrix which either corresponds to, or is closest to the selected printing speed.

By means of the temperature sensor 118, the processor 104 can measure the temperature of the thermal print head 102 and then select, from the data matrix, the temperature value corresponding to, or closest to this value.

From the data matrix, and using the above-chosen temperature and speed values, the processor 104 can then preferably select the reference energy value which is specified for the measured value of the thermal print head temperature and the selected or specified printing speed.

In addition to the above-determinations, the processor can also proceed with determining whether or not an ink ribbon is needed, or what type of ribbon is needed. On the basis of the ink ribbon data read into the working memory 124 and specific to the type of paper, and on the basis of the data supplied by the ink ribbon sensor 121, the processor 104 can then check for the following conditions:

A) whether there is a "1" in the second row of the ink ribbon data (indicating that an ink ribbon is needed), and whether a cassette 111 for the thermal transfer ink ribbon 110 has been inserted; or B) whether there is a "0" in this position and no cassette 111 has been inserted.

If the requirements indicated above are not fulfilled, the processor can be set up to indicate such to the operator by means of an error message, either a visible, or audible warning. The error message could also contain information as to how to correct the problem, for example, either to remove the wrong cassette 111 which has been inserted, or to insert the missing cassette 111.

The processor 104 can also check to see whether there is a "0" in the third row of the ink ribbon data list, or possibly another digit identifying a thermal transfer ink ribbon 110. On the basis of this value and the values supplied by the ink ribbon sensor 121, the processor 104 can check, if necessary, to see whether the correct thermal transfer ink ribbon 110 has been inserted. By means of an error message displayed on the LCD screen 123, or possibly by an audible warning, the operator can preferably be requested to insert the correct thermal transfer ink ribbon 110 into the printer, if necessary.

Also, on the basis of the data supplied by the paper sensor 120, the processor 104 can preferably check to see whether a label strip 107 has been inserted. A warning signal can also be generated if a paper strip is not present, indicating to the operator that paper needs to be inserted.

The processor 104 can then retrieve the printing information read into the first memory area 126 of the read/write memory 125, and initiate the printing process. To initiate the printing process, the processor 104 will essentially transmit the printing information, the selected or specified printing speed, and the reference energy value selected from the data matrix to the control circuit 103 of the thermal print head 102. The control circuit 103, by means of electrical connections and driver circuits (not shown, but commonly known in the art), can then drive the counterpressure roller 106 to transport the label strip 107, as well as the thermal transfer ink ribbon 110, preferably by means of electric motors, not shown in the figure. The motor for driving the ink ribbon 110 would preferably be connected to the take-up reel 113. The control circuit 103 can also preferably start the printing process itself by activating the individual heating elements 105 as a function of the input and measured data.

In addition, the control circuit 103 could also control operation of the drive mechanism 26, to thereby control the stopping device 100 and lift the print head 102 from the counterpressure roller 106.

The reference energy value determined from the printing speed and the thermal print head temperature essentially then controls the thermal energy generated by the heating elements 105. The thermal energy generated would preferably be greater, the higher the printing speed set, and the lower the measured thermal print head temperature. Preferably, the thermal energy can be controlled by changing the times at which a specified voltage is applied to the heating elements 105. Such heating elements 105 are preferably designed as resistance heating elements.

If the paper sensor 120 is configured as a laser scanner capable of reading bar codes, and if markings are applied to the labels in the form of bar codes which provide information on the type of paper used for the labels, the operation of the thermal printer 101 can essentially be automated because the type of paper for the labels need no longer be input manually by the operator, but the processor 104, by means of the paper sensor 120, can automatically identify which type of labels have been inserted. On the basis of the data received in this manner, the processor 104 retrieves the corresponding data matrix from the second memory area 127 of the read/write memory 125, and the ink ribbon data specified for the type of paper identified from the fourth memory area 129. Using these data, the thermal printer 101 can be controlled by the processor 104 as described above.

One type of cassette 111 for use in a printer such as the printer of FIG. 6 is depicted in greater detail with reference to FIGS. 7–19. In the printer depicted in FIG. 7, which essentially depicts a stopping arrangement in reverse image, a cassette 2' can be inserted into the printer 1' approximately perpendicular to the plane of the drawing. A rear wall 3' (see FIG. 12) of the printer 1' can preferably be penetrated by two externally-toothed shafts located at a lateral distance from one another, whereby for example the one shaft 4' can be connected to a drive motor, while the other shaft 5' can be a brake shaft connected to a slip clutch. The lateral distance 6' (see FIG. 8) between the two shafts 4' and 5' can preferably correspond to the distance between the holes of the cassette 2', or the distance between the shafts 4' and 5'.

Figure 7:
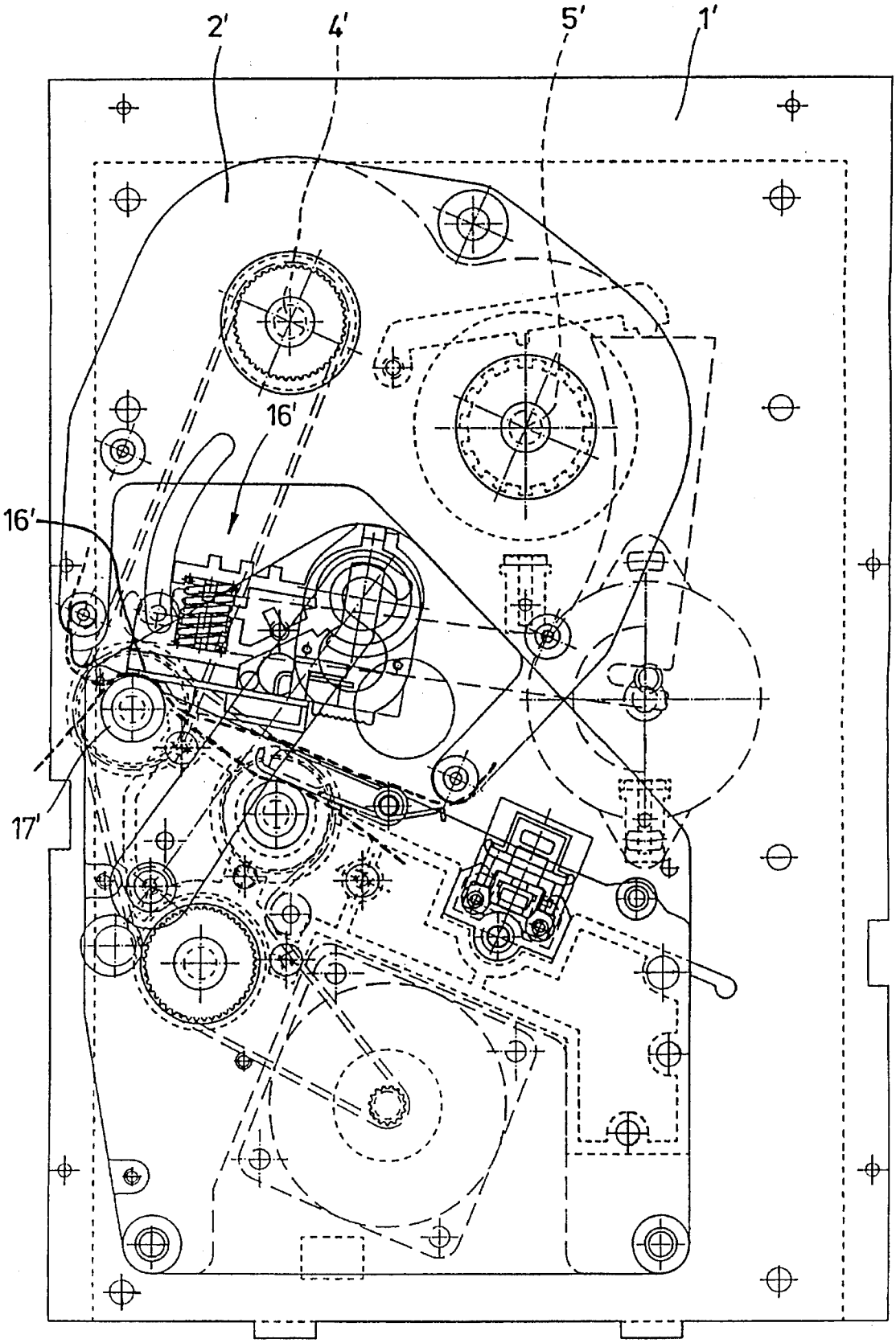
FIG. 7 schematically illustrates a side view of an alternative embodiment of a printer with an inserted cassette.
Figure 8:
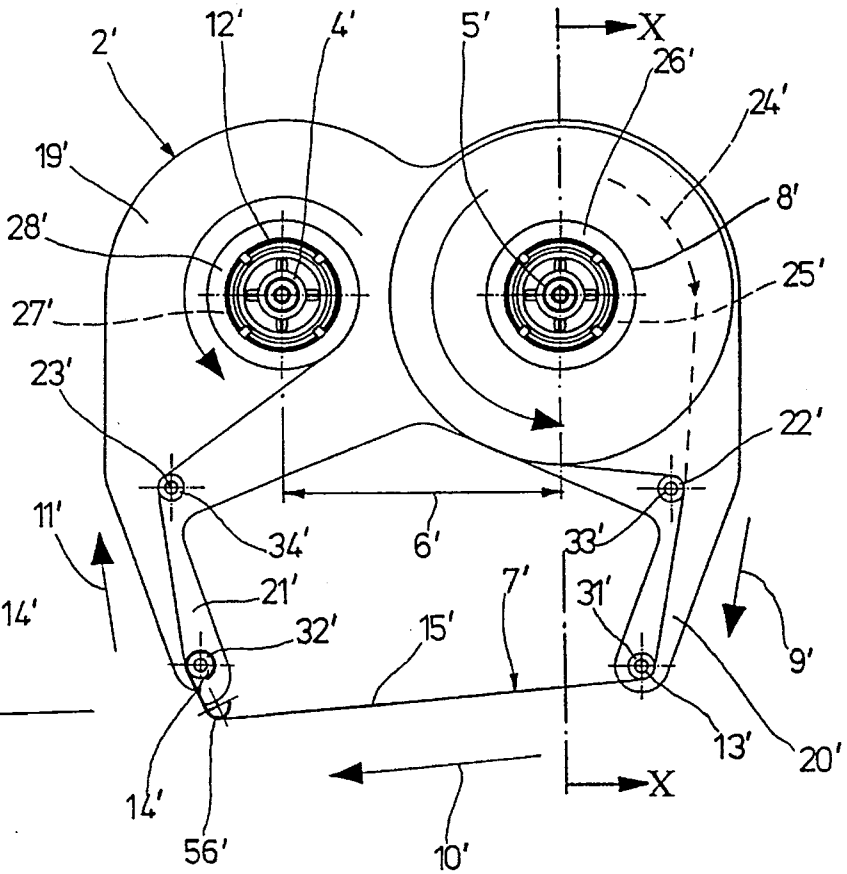
FIG. 8 is a plan view of a somewhat-modified cassette.
Figure 9:
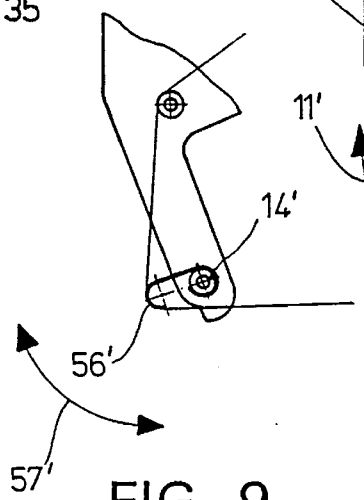
FIG. 9 is a detail of FIG. 8, with the guide plate in another position.
Figure 10:
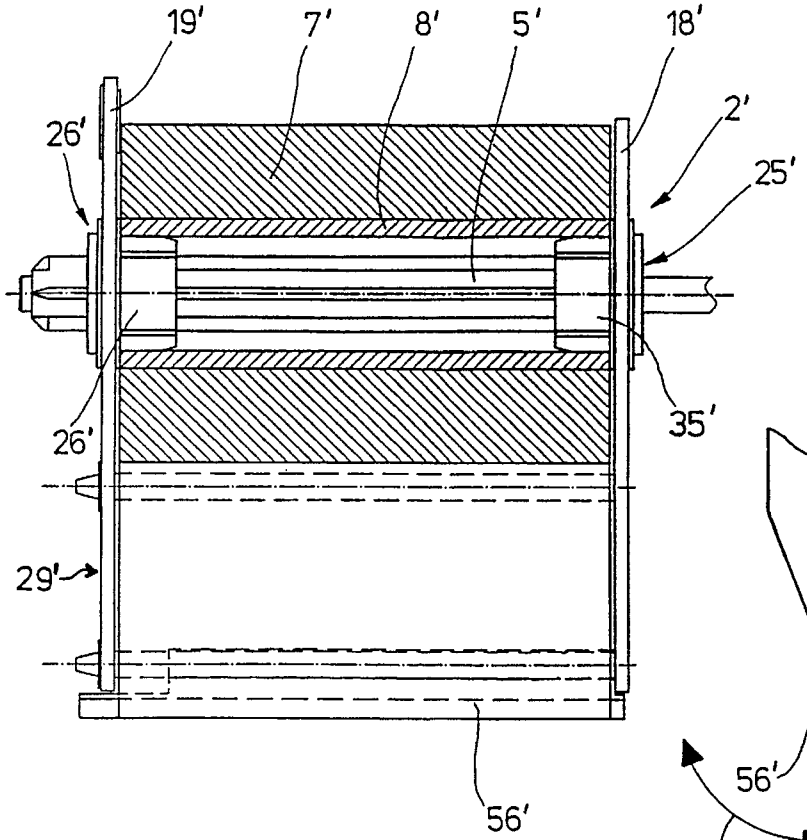
FIG. 10 is a cross section taken along line X—X in FIG. 8.

As shown in FIGS. 8 and 10, the cassette 2' holds a tape 7' which can preferably be on a core 8', preferably a core made of cardboard, while other materials are usable as well. When this tape 7' is to be paid out in the direction indicated by the arrows 9', 10' and 11' in FIG. 8, the tape 7' and the core 8' are first assigned to the brake shaft 5'. When the drive shaft 4' is driven, the ribbon 7' can be unwound from the core 8' and wound up on another core 12', which core 12' can preferably be penetrated by the drive shaft 4'. The ribbon 7' can also be deflected by means of deflectors 13' and 14' on the lower end of the cassette in FIG. 8. The segment of the ribbon 7' located between these deflector elements 13' and 14' can form the working, usable strand 15' of the ribbon 7'. This working strand 15' can preferably be guided between a printing head 16' of the printer 1' and a printing roller 17' (FIG. 7).

Figure 13:
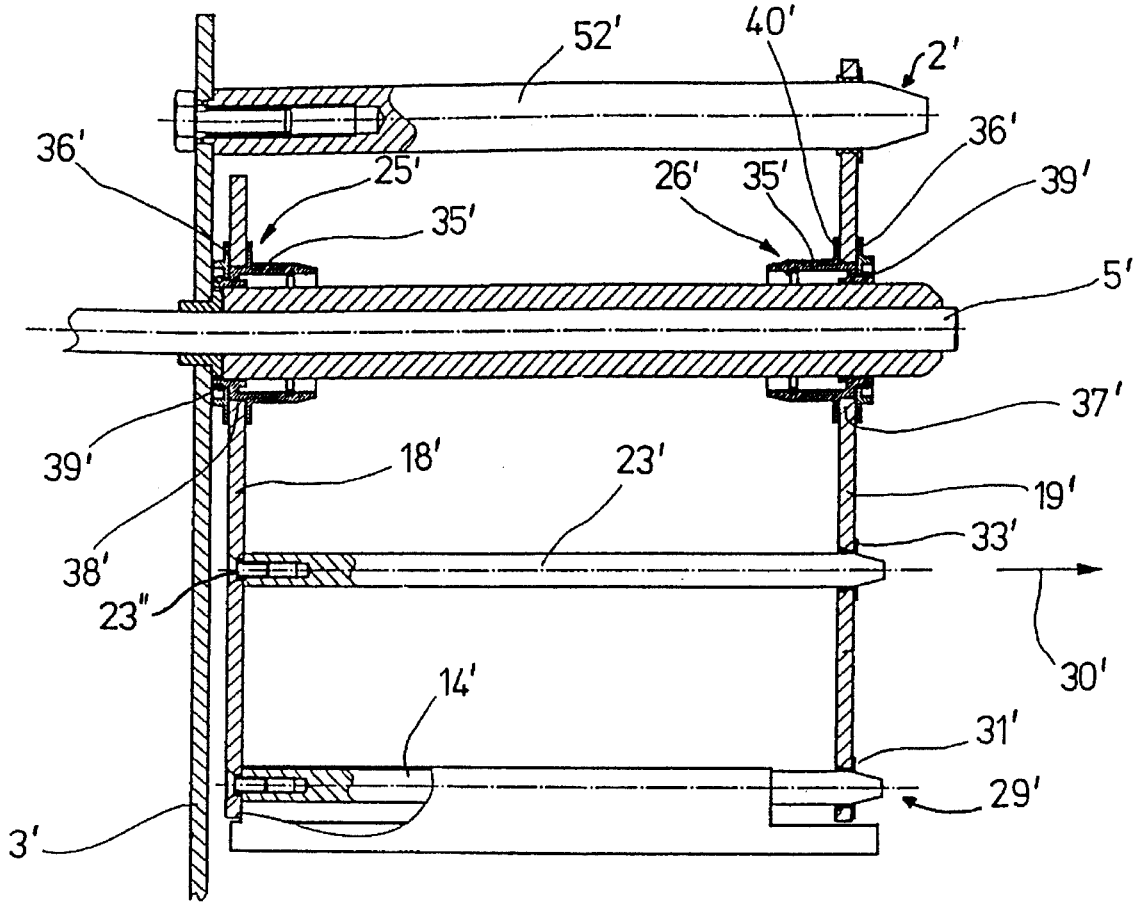
FIG. 13 is a cross section through the cassette illustrated in FIG. 8, whereby the cross section is essentially the same as the cross-section illustrated in FIG. 11.

The essential components of the cassette 2' can essentially be two parallel housing halves 18' and 19' as shown in FIG. 10. The housing halves 18' and 19' can essentially be C-shaped, as shown in FIG. 8, so that cassette arms 20' and 21' are formed. The two deflector elements 13' and 14' which can be pins, pointed on the free end thereof, as illustrated in FIG. 13, for example, can preferably be attached to the free ends of the arms.

Approximately at the transition to each arm 20' and 21', there can preferably be respective additional deflector elements 22' and 23' for the ribbon 7'. Also as illustrated in FIG. 13, these additional deflector elements 22' and 23' can preferably be pointed pins which can be fastened to the housing half 18' by means of a screw 23", i.e. preferably to the housing half which corresponds to the rear wall 3'. The ribbon 7' can either be unwound as shown by the solid line in FIG. 8, or, alternatively, can be unwound as shown by the dotted line 24' in FIG. 8. As such, the cassette 2' can be used both for an externally-wound ribbon or tape 7' and for an internally wound ribbon.

Additional important elements of the cassette 2', include at least one core on each shaft 4' and 5' respectively But in all the embodiments, instead of one long core on each shaft 4' and 5', there can alternatively be, two short, coaxial cores 25' and 26' or 27' and 28' respectively, as shown in FIGS. 8 and 10. Each pair of cores 25', 26' and 27', 28' can hold the ends of a tape core 8' or 12' respectively. The cores 25' and 27' can be mounted so that they can rotate in the first housing half 18', and the cores 26' and 28' so that they can rotate in the second housing half 19'. Each core 25' to 28' can be designed in two parts as illustrated in FIG. 13, for example, which facilitates the installation of the cores in the housing 29'. This housing 29', as described above, can be formed from the two housing halves 18' and 19' and the deflector elements 13', 14', 22' and 23', preferably formed by pins.

Figure 11:
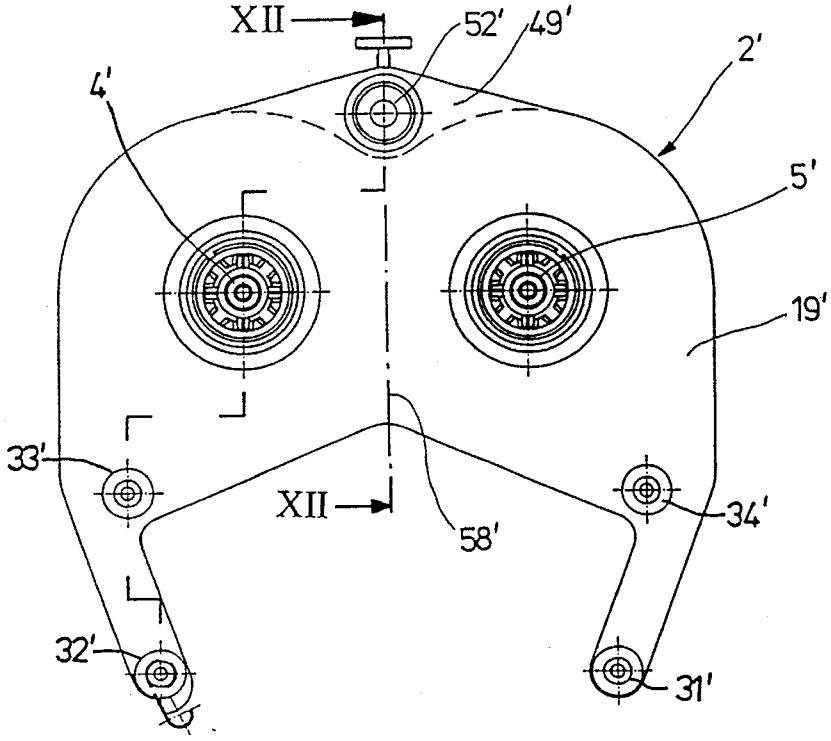
FIG. 11 is a plan view of the cassette illustrated in FIG. 7.

The housing half 19' can be pulled off the pins 13', 14', 22' and 23' (shown in FIG. 8) in the direction of the arrow 30' (shown in FIG. 13), and can preferably be held on the free ends of the pins essentially only by clamping. The deflector elements 13', 14', 22' and 23' can provide for a correct positioning of the housing half 19', and can each be preferably held by a bushing, preferably a plastic bushing 31', 32', 33' and 34' as shown in FIG. 8 and 11, in each opening of the second housing half 19'.

In an alternative embodiment of the apparatus, the bushings 31'–34' could be optional if the surfaces of the pins 13', 14' 22' and 23' or of the adjoining orifices through which the pins pass, had a surface treatment which performed in the same manner as the bushing 31'–34'. For example, a plastic, or possible teflon coating could be applied to form a wear layer with an appropriate friction coefficient that facilitated movement of the housing halves 18' and 19' along the pins 13', 14' 22' and 23'.

As shown in FIG. 13, for example, all the cores 25' to 28' can be designed in two pieces, and each of them can be formed by a sleeve-shaped base part 35' and a ring-shaped retaining part 36' which can be connected to the cores. The sleeve-shaped base parts 35' can be inserted in corresponding holes 37' and 38' in the housing halves 19' and 18' respectively. The ring-shaped retaining part 36' can be inserted onto the projecting end, and can be axially secured by means of a retaining element 39', preferably a retaining ring, which retaining element 39' could preferably snap into a groove 41A' as shown in FIGS. 15 and 17. Each sleeve-shaped base element 35' can be in contact by means of an external shoulder 40' (see FIGS. 15 and 17) against the inside surface of the corresponding housing half 18' or 19' respectively. Opposite, on the outside of each housing half 18' or 19' the ring-shaped retaining part 36' can preferably axially secure each base element to the housing half 18' or 19' respectively.

FIGS. 15 and 17 show in particular that the base part 35' becomes smaller in a stepped fashion, whereby the ring-shaped retaining part 36' can be pressed onto the smaller sleeve-shaped partial piece 41' as shown in FIG. 13, and the retaining element 39' can be locked to the retaining element 36' via notch 41A'. This partial piece 41' can be elongated into the inside of the core, as shown in FIGS. 15 and 17. In any case, on the smaller, sleeve-shaped partial piece 41' of the first cores 26' and 28', there can be internal teeth 42' (see FIGS. 16 and 17) which can correspond to the external teeth 43' on the shafts 4' and 5' respectively, see FIGS. 18 and 19. Such internal teeth could also be provided on all the sleeve-shaped base parts 35', but the embodiments specify that the sleeve-shaped base parts 35' of the second cores 25' and 27' have a hole 44' with a preferably smooth inner surface, as shown in FIGS. 14 and 15. The free ends of the teeth 43' of the shafts 4' and 5' can then be in contact with this smooth inner surface.

FIGS. 15 and 17 also show that the sleeve-shaped base parts 35' can be provided in the vicinity of their larger diameter with slots 45', thereby forming flexible tabs 46'. FIGS. 14 and 16 show that the flexible tabs 46', of FIGS. 15 and 17, can each have a radially projecting retaining element 47' on the outside, preferably in the form of a small radial strip. This can improve the frictional and interlocking connection between the cores 25' to 28" and the tape cores 8' and 12' respectively. To maintain the clamping action between the tabs 46' and the tape cores 8' and 12', the tabs 46' can be permanently pushed radially outward by a retaining ring (not shown) which can be inserted in an internal groove 59'. As shown in FIGS. 16 and 19, there can be a larger number, e.g. twice the number of locator grooves 48' than the number of teeth 43', i.e. eight grooves 48' as compared to only four teeth 43'.

Figure 12:
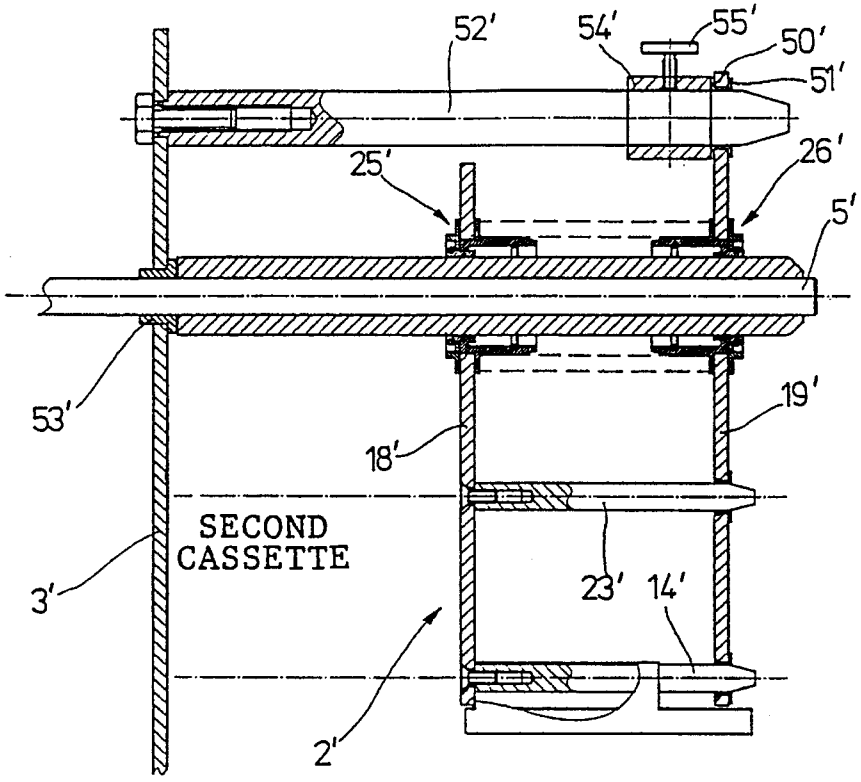
FIG. 12 is a cross section taken along line XII—XII in FIG. 11.

The cassette 2' illustrated in FIG. 13 is intended for relatively wide tapes 7'. But it is also possible to install narrower tapes 7' in this cassette 2', because the second housing half 19' can be mounted so that it can move on the pin-like deflector elements 13', 14', 22' and 23', and can be held in each position by friction. But if the second housing half 19', starting from its position in FIG. 13, is moved to the left toward the first housing half 18', the free ends of the pins on the right project beyond the housing half 19'. If this is unacceptable for any reason, or at least if it is undesirable, shorter pins can be used instead. A change-over from long pins to short pins can essentially be performed very easily, because the pins are simply screwed or bolted onto the first housing half 18'. FIG. 12 shows one embodiment with short pins or deflector elements 13', 14'; 22', 23'.

Otherwise, however, this embodiment of FIG. 12, is designed similarly to the cassette 2' illustrated in FIG. 13, with essentially only one slight difference, namely that the shape of the housing half 19' of FIG. 12, on its upper end, differs from the shape of the cassette illustrated in FIG. 8. In the embodiment of FIG. 12, the housing half 19' can be provided on its upper end with a bulge 49' (see FIGS. 11 and 12) in which there is a passage 50'. In the latter case, a bearing bushing 51', preferably made of plastic, is inserted. When this cassette is inserted into the printer 1', a locator pin 52' located on the rear wall 3' of the printer 1' can be engaged in the hole of the bearing bushing 51'. The cassette 2' illustrated in FIGS. 11 and 12 can be securely fixed in the printer 1' by means of this locator pin 52' and the two shafts 4' and 5'. To facilitate the insertion of the cassette 2', the free end of the locator pin 52' can preferably be somewhat pointed. As shown in the accompanying figures, the same can be true of the shafts 4' and 5'. The shafts 4' and 5' can also each run through a bearing bush 53' in the wall 3'. The bearing bush 53' in the wall 3' is preferably used for the axial and radial support of the shafts.

Because the cassette 2' illustrated in FIG. 12 is narrower than the cassette 2' in FIG. 13, the thickness of which equals approximately the length of the shafts 4' and 5', to the extent that the shafts 4' and 5' project beyond the wall 3', the precise position of the cassette 2' with respect to the printer 1' or its wall 3' must be specified by suitable means. One possibility is to place a sliding collar 54' with a set screw 55' over the locator pin 2'. It is easy to see that by pushing the sliding collar 54' toward the left, i.e. toward the wall 3', the stop formed by the sliding collar can be moved, and thus the cassette 2' can be moved back closer to the wall 3'. On the other hand, as shown in FIG. 12, it could also be possible to install two cassettes 2' (one of which is shown only schematically) next to one another in the printer 1', whereby each cassette can be loaded with an individual printing ribbon, e.g. with ribbons of different colors.

It is also possible first to print any labels or similar material with the cassette 2' in the position illustrated in FIG. 12, and then to push the cassette 2' all the way to the left, to then apply a second impression next to the first impression on the material being printed.

In the vicinity of at least one of the deflector elements 13', 14' in the embodiment illustrated in FIG. 8, on the deflector element 14', there can preferably be a guide plate 56' which can be pivotably mounted on this deflector element 13' or 14', so that the guide plate 56' can pivot in the direction shown by the double arrow 57'. The guide plate 56' can preferably be clamped in its respective pivot position. The working position of the guide plate 56' is shown in FIG. 8. The usable strand 15' can thereby be pulled out beyond the free end of the cassette arm 21'. If, on the other hand, the guide plate 56' were to be moved into the angular position illustrated in FIG. 9, the strand 15' would not project downward beyond the free end of the housing 29', but if necessary, would project laterally beyond the outside of the cassette arm 21'. But that is irrelevant when the cassette 2' is installed in the printer 1', in terms of a danger of damage to the ribbon. By pulling the left end of the usable strand 15' out of the cassette 2', as shown in FIG. 8, the printing roller 17' (shown in FIG. 7) could be wrapped over a somewhat greater angle, thereby increasing frictional engagement between the printing roller 17' and the strand 15', which would be advantageous for printing at a high ribbon speed.

Because the cassette 2' is symmetrical along a longitudinal center plane 58' (FIG. 11), it can be used as a reversible cassette, i.e. after the ribbon 7' has run all the way through, the cassette 2' can preferably be simply turned over like known audio cassettes, and the ribbon 7' can be run through once again. For such reversibility, a guide plate 56' could preferably also be required on the cassette arm 20'. Either a guide plate 56', as shown in FIGS. 8 and 10, can be attached to both cassette arms 20' and 21', or the guide plate 56' can be switched from one cassette arm to the other, so that it can be removed from the cassette arm 21' and pushed onto the cassette arm 20' after the cassette 2' has been turned over.

The cassettes 2' described above can be assembled and disassembled easily. In particular, the cassette 2' can be inserted into the printer 1' easily as a result of the design of the shafts 4' and 5' and the corresponding cores 25' to 28' in a self-locating mechanism, whereby the ease of insertion can be further increased if there are twice the number of locator grooves 48'.

One feature of the invention resides broadly in the control circuit for a thermal printing machine, with a thermal print head 1 having a series of electrically drivable heating elements 14, with a microprocessor 2 transferring data to be printed into a register 13 which is associated with the thermal print head 1 and drives driver circuits connected to the heating elements 14, said register 13 receiving the data in serial form, characterized by a buffer storage 15 connected to the microprocessor 2 via a parallel data line, as well as by a separate load state monitoring circuit 17 connected to the buffer storage 15 and causing data to be transferred from the buffer storage 15 into the register 13 when the data written into the buffer storage 15 from the microprocessor 2 has reached a defined quantity.

Another feature of the invention resides broadly in the control circuit characterized in that the defined quantity of data necessary for causing the transmission of data from the buffer storage 15 into the register 13 is lower than the quantity of data necessary for driving the whole line of heating elements 14.

Yet another feature of the invention resides broadly in the control circuit characterized in that the microprocessor 2 writes data into the buffer storage 15 concurrently with the transmission of data from the buffer storage 15 into the register 13.

Still another feature of the invention resides broadly in the control circuit characterized in that the microprocessor 2 stops feeding data to the buffer storage 15 after data for driving a complete line of heating elements 14 is transmitted, yet starts transmitting data of the subsequent line after at least part of the data is transmitted from the buffer storage 15 to the register 13.

A further feature of the invention resides broadly in the control circuit characterized in that the buffer storage 15 is a first-in-first-out storage.

Another feature of the invention resides broadly in the control circuit characterized in that the microprocessor 2 and/or the load state monitoring circuit 17 include(s) an output connected to an input of the print head 1 for a print release signal (e) for activating the heating elements 14 via a circuit 7 generating a signal comprised of an initial continuous pulse followed by rectangular pulses of a higher frequency.

Yet another feature of the invention resides broadly in the control circuit characterized in that the thermal print head 1 includes a temperature sensor 8 connected to the microprocessor 2, and that the microprocessor 2 varies the duration of the pulses and/or the pulse spaces of the circuit 7 in dependence upon the output signal of the temperature sensor 8.

Still another feature of invention resides broadly in the control circuit characterized in that the microprocessor 2 varies the duration of the pulses and/or the pulse spaces in dependence upon the printing speed and/or the type of the printed paper.

A further feature of the invention resides broadly in the control circuit for a printing machine, with a print head 1 adapted to be moved into contact with a platen roll 12 driven by a stepping motor 11, with a microprocessor 2 including an output connected to the stepping motor 11, characterized in that a pulse generator 9 and a stepping motor driver 10 are inserted between the output of the microprocessor 2 and the stepping motor 11.

Another feature of the invention resides broadly in the control circuit characterized in that for generating colored print images the microprocessor 2 controls an additional print head 23 and drives, via a further pulse generator 19 and via a further stepping motor driver 20 and a further stepping motor 21, a further platen roll 22 against which the additional print head 23 rests.

Some types of printers and the various components thereof which could be used in conjunction with the present invention may be or are disclosed by the following U.S. Pat. Nos.: 5,160,943 to Pettigrew et al., entitled "Printing Systems"; 5,055,858 to Koch, entitled "Thermal Print Head"; 5,023,628 to Koch, entitled "Thermal Head Mounting/Positioning Assembly"; 5,165,806 to Collins, entitled "Thermal Printer with Movable Drive Roll"; 4,326,813 to Lomicka and Heller, entitled "Dot Matrix Character Printer Control Circuitry for Variable Pitch Printing"; and 4,214,836 to Wang, entitled "Impact Print Head".

Some types of microprocessors which could possibly be used in directing the printer in accordance with the present invention may be or are disclosed by the following U.S. Pat. Nos.: 5,237,441 to Nhu, entitled "Microprocessor Chip Incorporating Optical Signal Coupling Transceiver"; 5,214,560 to Jensen, entitled "Microprocessor Watch-dog Monitor for Electronic Trip Units"; 5,187,352 to Blair and Brooks, entitled "Microprocessor Controlled Security System for Computers"; and 5,201,056 to Daniel and Short, entitled "RISC Microprocessor Architecture with Multi-bit Tag Extended Instructions for Selectively Attaching Tag from either Instruction or Input Data to Arithmetic Operation Output".

Some types of buffer storage devices which could possibly be used to store data in accordance with the present invention may be or are disclosed by the following U.S. Pat. Nos.: 5,249,271 to Hopkinson and Wang, entitled "Buffer Memory Data Flow Controller"; 5,185,876 to Nguyen and Gajjar, entitled "Buffering System for Dynamically Providing Data to Multiple Storage Elements"; and 5,276,808 to Cheney et al., entitled "Data Storage Buffer System and Method".

Some types of load state monitoring circuits which could possibly be used to cause data to be transferred from buffer storage to the register in accordance with the present invention may be or are disclosed by the following U.S. Pat. Nos.: 5,249,271 to Hopkinson and Wang, entitled "Buffer Memory Data Flow Controller"; 5,291,070 to Witt, entitled "Microprocessor Synchronous Timing System"; 5,287,353 to Buda and Peele, entitled "Apparatus for Generating and Sending a Serial Data Packet for Controlling a Network of Single Point I/O Devices"; and 5,228,066 to DeVane, entitled "System and Method for Measuring Computer System Time Intervals".

Some types of data input interface circuits which could possibly be connected to the microprocessor to be used in accordance with the present invention may be or are disclosed by the following U.S. Pat. Nos.: 5,291,609 to Herz, entitled "Computer Interface Circuit"; and 5,235,685 to Caldara et al., entitled "Interface Bus with Independent Data, Command and Direct Control Sections for Parallel Transfer of Information Between Host and Intelligent Storage".

Some types of control keyboards which could possibly be used to input data to be processed by the microprocessor in accordance with the present invention may be or are disclosed by the following U.S. Pat. Nos.: 5,251,292 to Martel and Moon, entitled "Method and Apparatus for an Equation Editor"; 5,181,029 to Kim, entitled "Electronic Keyboard Template"; and 5,296,845 to Haller, entitled "Computer Keyboard for Use with Software for Playing Games or Solving Puzzles".

Some types of register elements which could possibly be used to store data and transfer data to the printing heads in accordance with the present invention may be or are disclosed by the following U.S. Pat. Nos.: 5,232,294 to Inui, entitled "Recording Head Driving Device for Printer"; 5,312,193 to Kringe et al., entitled "Control Device for a Matrix Printer"; and 5,195,176 to Lung, entitled "Method and Apparatus to Enhance Laser Printer Speed and Functionality".

Some types of thermal printer heads which could possibly be used to print the data images in accordance with the present invention may be or are disclosed by the following U.S. Pat. Nos.: 5,176,458 to Wirth, entitled "Multiple Position Thermal Printer Head Mechanism which Is Disturbance Insensitive"; 5,211,493 to Stephenson et al., entitled "Cooling System for a Thermal Printing Head"; and 5,268,706 to Sakamoto, entitled "Actuating Control Method of Thermal Head".

Some types of thermal sensors which could possibly be used with thermal head heat sensors and that could possibly be used to register the temperature of the thermal heads may be or are disclosed by the following U.S. Pat. Nos.: 5,208,607 to Ohashi and Tokumasu, entitled "Thermal Recording Method Using Drive Signal Pulse Widths Changed at Time Intervals within Thermal Head Temperature Measuring Time Intervals"; and 5,266,967 to Maslanka and Moore, entitled "Edge Reading Donor Sensors for a Thermal Printer".

Some types of data converters that could possibly be used to convert parallel data to serial data in accordance with the present invention may be or are disclosed in the following U.S. Pat. Nos.: 5,223,841 to Ricker, entitled "Calibration Method and Apparatus for Collecting the Output of an Array of Detector Cells"; 5,253,254 to Roberts and Manley, entitled "Telecommunications System with Arbitrary Alignment Parallel Framer"; and 5,257,211 to Noga, entitled "Adjustable Bandwidth Concept (ABC) Signal Energy Detector".

Some types of pulse generators which could possibly be used to generate pulses in accordance with the present invention may be or are disclosed by the following U.S. Pat. Nos.: 5,235,699 to Shaffer et al., entitled "Timing Calibrate and Track Control Circuit"; 5,249,132 to Lueker et al., entitled "Digital Pulse Generator"; and 5,309,514 to Johnson and West, entitled "Pulse Generator Including a Memory for Storing Pulses for Modulation on a Carrier of a Television Signal".

Some types of stepping motors that could possibly be used to drive the platen rolls in accordance with the present invention may be or are disclosed by the following U.S. Pat. Nos.: 5,272,401 to Lin, entitled "Stepping Motor Design"; 5,208,523 to Harman, entitled "Stepper Motor with Vernier Control Mode"; and 5,206,568 to Bjornson et al., entitled "Coordinated Control of Stepper Motors".

Some types of platen rollers that could possibly be used to feed printing paper to the printer apparatus may be or are disclosed by the following U.S. Pat. Nos.: 5,329,302 to Fogle and Strausburg, entitled "Tapered Platen Roller for Thermal Printer"; and 5,182,573 to Kim, entitled "Multi-color-thermal Printer with a Movable Printer Head".

Some types of read/write control circuits that could possibly be used to read data into the data converter in accordance with the present invention may be or are disclosed by the following U.S. Pat. No. : 5,247,643 to Shottan, entitled "Memory Control Circuit for Optimizing Copy Back/Line Fill Operation in a Copy Back Cache System".

Some types of thermal color printers and the various components thereof which could be used in conjunction with the current invention may be or are disclosed by the following U.S. Pat. Nos.: 5,266,968 to Stephenson, entitled "Non-volatile Memory Thermal Printer Cartridge"; 5,270,735 to Fiscella and Pickering, entitled "Printer Drive"; and 5,182,573 to Kim, entitled "Multi-color-thermal Printer' with a Movable Printer Head".

In summary, the present invention, in at least one preferred embodiment thereof, relates to a control circuit for a thermal printing machine, with a thermal print head having a series of electrically drivable heating elements, with a microprocessor transferring data to be printed into a register associated with the thermal print head and driving driver circuits connected to the heating elements, the register receiving the data in serial form.

Further, the present invention, in at least one preferred embodiment thereof, is directed to a control circuit for a thermal printing machine, with a thermal print head 1 having a series of electrically drivable heating elements 14, with a microprocessor 2 transferring data to be printed into a register 13 associated with the thermal print head 1. In order to increase the printing speed, a buffer storage 15 connected to the microprocessor 2 via a parallel data line as well as a separate load state monitoring circuit 17 are proposed, the monitoring circuit being connected to the buffer storage 15 and causing data to be transferred from the buffer storage 15 into the register 13 when the data written into the buffer storage 15 from the microprocessor 2 has reached a defined quantity.

As an alternative or addition, it can be recommended to insert a pulse generator 9 and a stepping motor driver 10 between the output of the microprocessor 2 and the stepping motor 11 for driving the platen roll 12.

All, or substantially all, of the components and methods of the various embodiments may be used with at least one embodiment or all of the embodiments, if any, described herein.

All of the patents, patent applications and publications recited herein, and in the Declaration attached hereto, are hereby incorporated by reference as if set forth in their entirety herein.

The corresponding foreign patent publication applications, namely, Federal Republic of Germany Patent Application No. P 43 32 572.6, filed on Sep. 24, 1993, having inventor Gamal Hagar, and DE-OS P 43 32 572.6 and DE-PS P 43 32 572.6, as well as their published equivalents, and other equivalents or corresponding applications, if any, in corresponding cases in the Federal Republic of Germany and elsewhere, and the references cited in any of the documents cited herein, are hereby incorporated by reference as if set forth in their entirety herein.

The details in the patents, patent applications and publications may be considered to be incorporable, at applicant's option, into the claims during prosecution as further limitations in the claims to patentably distinguish any amended claims from any applied prior art.

The appended drawings in their entirety, including all dimensions, proportions and/or shapes in at least one embodiment of the invention, are accurate and to scale and are hereby included by reference into this specification.

The invention as described hereinabove in the context of the preferred embodiments is not to be taken as limited to all of the provided details thereof, since modifications and variations thereof may be made without departing from the spirit and scope of the invention.

What is claimed is:

1. A thermal printer for printing an image on a carrier, said printer comprising:

a housing;

means for printing an image onto a carrier;

said printing means being disposed at said housing;

means for permitting movement of the carrier to said printing means and away from said printing means;

a microprocessor;

said microprocessor comprising means for converting input data from an input source into image data;

means for storing and buffering image data;

said buffer storage means comprising means for storing image data received from said microprocessor;

means for transmitting image data from said microprocessor to said buffer storage means;

said buffer storage comprising means of transmitting image data upon a first predetermined condition being met;

a register;

said register comprising means for storing image data received from the said buffer storage means;

means for transmitting image data from said buffer storage means to said register;

said printing means comprising a print head means;

said print head means comprising at least one printing element;

means for transmitting image data from said register to said print head;

means for activating said at least one printing element to permit the printing of image data onto a carrier by said at least one printing element.

2. The thermal printer according to claim 1 wherein said means for transmitting image data from said microprocessor to said buffer storage means comprises a parallel data line for transmitting data in parallel, substantially simultaneously among a plurality of connected wires.

3. The thermal printer according to claim 2 wherein:

said buffer storage means comprises a load state monitoring circuit;

said load state monitoring circuit comprises means for transmitting image data from said buffer storage means to said register upon a first predetermined condition being met in said buffer storage means.

4. The thermal printer according to claim 3 wherein the means for transmitting image data from said buffer storage means to said register comprises means for transmitting image data in serial form, sequentially over one line.

5. The thermal printer according to claim 4 wherein said first predetermined condition comprises a predetermined quantity of image data for transmission of image data from said storage buffer means to said register, and said buffer storage means comprises means for generating a signal for transmitting data from said buffer storage means to said register upon said first predetermined condition being met.

6. The thermal printer according to claim 5 wherein:

said register means comprises register elements for accepting image data;

said register elements capable of storing a sufficient quantity of image data to print the image data onto a carrier;

said quantity of stored image data sufficient to print stored image data stored in said register elements onto a carrier, comprising a second predetermined condition;

said quantity of data relating to said first predetermined condition is less than said quantity of data relating to said second predetermined condition.

7. The thermal printer according to claim 6 wherein said microprocessor comprises means for transmitting image data into said buffer storage means concurrently with the transmitting of image data from said buffer storage means to said register.

8. The thermal printer according to claim 7 wherein:

said microprocessor comprises means for stopping transmission of image data to said buffer storage means upon said second predetermined condition being met;

said microprocessor comprises means to begin transmitting additional image data to the buffer storage means after at least part of the image data in said buffer storage means is transmitted from said buffer storage means to said register.

9. The thermal printer according to claim 8 wherein said buffer storage means comprises means for transmitting image data from said buffer storage means to said register in the same time order in which the image data was transmitted from said microprocessor to said buffer storage means to provide first-in-first-out storage.

10. The thermal printer according to claim 9 wherein:

said print head means comprises at least one input;

at least one of:

said microprocessor and said load state monitoring circuit comprises an output operatively connected to the input of said print head means;

said microprocessor comprises means for generating a print release signal;

a print release signal circuit;

said microprocessor being connected for transmitting print release signals to said print release signal circuit;

said print release signal circuit comprises means for generating a signal comprising an initial continuous pulse followed by rectangular pulses of a higher frequency when a print release signal is received from said microprocessor;

said load state monitoring circuit comprises means for transmitting said print release signal;

means for transmitting said print release signal to said print release signal circuit.

11. The thermal printer according to claim 10 wherein:

said print head means comprises a sensor for measuring the temperature of said print head means;

means for connecting said temperature sensor to said microprocessor;

said microprocessor comprises means for varying the signal generated by said print release signal circuit based upon temperature data received from said temperature sensor.

12. The thermal printer according to claim 11 including:

means for determining at least one of:

speed of printing an image by said print head means onto a carrier and at least one characteristic of a carrier to be printed upon;

means for transmitting the determined information determined by said means for determining to said microprocessor;

said microprocessor comprises means for varying the signal generated by said print release signal circuit based upon the determined information determined by said means for determining.

13. The thermal printer according to claim 12 wherein:

said print head means;

platen roll means;

said platen roll means comprising means for moving the carrier into contact with said print head means;

a stepping motor;

said stepping motor comprising means for rotating said platen roll means;

a pulse generator;

said pulse generator comprising means for generating a signal to energize said rotating means thus running said stepping motor;

means for connecting said platen roll to said stepping motor;

means for connecting said stepping motor to said pulse generator;

means for connecting said pulse generator to said microprocessor;

said microprocessor comprises means for generating a start signal for transmission to said pulse generator.

14. The thermal printer according to claim 13 wherein:

said microprocessor comprises means for controlling at least one additional print head means and means for moving the carrier into contact with said at least one additional print head means;

at least one said at least one additional print head means comprising at least one color print head means;

said at least one additional print head means and means for moving the carrier into contact with said additional print head means to produce color images.

15. In a thermal printer for printing an image on a carrier, said printer comprising: a housing; means for printing an image onto a carrier; said printing means being disposed at said housing; means for permitting movement of the carrier to said printing means and away from said printing means;

circuitry for receiving input data from an input source and transforming the input data into image data to be printed onto a carrier;

said circuitry comprising:

a microprocessor;

said microprocessor comprising means for converting input data from an input source into image data;

means for storing and buffering image data;

said buffer storage means comprising means for storing image data received from said microprocessor;

means for transmitting image data from said microprocessor to said buffer storage means;

said buffer storage comprising means for transmitting image data upon a first predetermined condition being met;

a register;

said register comprising means for storing image data received from the said buffer storage means;

means for transmitting image data from said buffer storage means to said register;

said printing means comprising a print head means;

said print head means comprising at least one printing element;

means for transmitting image data from said register to said print head;

means for activating said at least one printing element to permit the printing of image data onto a carrier by said at least one printing element.

16. The circuitry according to claim 15 wherein:

said means for transmitting image data from said microprocessor to said buffer storage means comprises a parallel data line for transmitting data in parallel, substantially simultaneously among a plurality of connected wires;

said buffer storage means comprises a load state monitoring circuit;

said load state monitoring circuit comprises means for transmitting image data from said buffer storage means to said register upon a first predetermined condition being met in said buffer storage means;

the means for transmitting image data from said buffer storage means to said register comprises means for transmitting image data in serial form, sequentially over one line;

said first predetermined condition comprises a predetermined quantity of image data for transmission of image data from said storage buffer means to said register, and said buffer storage means comprises means for generating a signal for transmitting data from said buffer storage means to said register upon said first predetermined condition being met;

said register means comprises register elements for accepting image data;

said register elements capable of storing a sufficient quantity of image data, to print the image data onto a carrier;

said quantity of stored image data sufficient to print stored image data stored in said register elements onto a carrier, comprising a second predetermined condition;

said quantity of data relating to said first predetermined condition is less than said quantity of data relating to said second predetermined condition;

said microprocessor comprises means for transmitting image data into said buffer storage means concurrently with the transmitting of image data from said buffer storage means to said register;

said microprocessor comprises means for stopping transmission of image data to said buffer storage means upon said second predetermined condition being met;

said microprocessor comprises means to begin transmitting additional image data to the buffer storage means after at least part of the image data in said buffer storage means is transmitted from said buffer storage means to said register;

said buffer storage means comprises means for transmitting image data from said buffer storage means to said register in the same time order in which the image data was transmitted from said microprocessor to said buffer storage means to provide first-in-first-out storage;

said print head means comprises at least one input;

at least one of:

said microprocessor and said load state monitoring circuit comprises an output operatively connected to the input of said print head means;

said microprocessor comprises means for generating a print release signal;

a print release signal circuit;

said microprocessor being connected for transmitting print release signals to said print release signal circuit;

said print release signal circuit comprises means for generating a signal comprising an initial continuous pulse followed by rectangular pulses of a higher frequency when a print release signal is received from said microprocessor;

said load state monitoring circuit comprises means for transmitting said print release signal;

means for transmitting said print release signal to said print release signal circuit;

said print head means comprises a sensor for measuring the temperature of said print head means;

means for connecting said temperature sensor to said microprocessor;

said microprocessor comprises means for varying the signal generated by said print, release signal circuit based upon temperature data received from said temperature sensor;

means for determining at least one of:

speed of printing an image by said print head means onto a carrier and at least one characteristic of a carrier to be printed upon;

means for transmitting the determined information determined by said means for determining to said microprocessor;

said microprocessor comprises means for varying the signal generated by said print release signal circuit based upon the determined information determined by said means for determining;

said print head means;

platen roll means;

said platen roll means comprising means for moving the carrier into contact with said print head means;

a stepping motor;

said stepping motor comprising means for rotating said platen roll means;

a pulse generator;

said pulse generator comprising means for generating a signal to energize said rotating means thus running said stepping motor;

means for connecting said platen roll to said stepping motor;

means for connecting said stepping motor to said pulse generator;

means for connecting said pulse generator to said microprocessor;

said microprocessor comprises means for generating a start signal for transmission to said pulse generator;

said microprocessor comprises means for controlling at least one additional print head means and means for moving the carrier into contact with said at least one additional print head means;

at least one said at least one additional print head means comprising at least one color print head means;

said at least one additional print head means and means for moving the carrier into contact with said additional print head means to produce color images.

17. A method of operating a thermal printer for printing an image on a carrier, said printer comprising: a housing; means for printing an image onto a carrier; said printing means being disposed at said housing; means for permitting movement of the carrier to said printing means and away from said printing means; a microprocessor; said microprocessor comprising means for converting input data from an input source into image data; means for storing and buffering image data; said buffer storage means comprising means for storing image data received from said microprocessor; means for transmitting image data from said microprocessor to said buffer storage means; said buffer storage comprising means for transmitting image data upon a first predetermined condition being met; a register; said register comprising means for storing image data received from the said buffer storage means; means for transmitting image data from said buffer storage means to said register; said printing means comprising a print head means; said print head means comprising at least one printing element; means for transmitting image data from said register to said print head; means for activating said at least one printing element to permit the printing of image data onto a carrier by said at least one printing element; said method comprising the steps of:

providing the housing;

providing the printing means;

providing the carrier;

printing an image onto the carrier with the printing means;

disposing of the printing means at said housing;

providing the moving means;

moving the carrier to said printing means and away from said printing means;

providing the microprocessor;

providing means for converting input data to image data;

providing means for storing and buffering image data;

providing means for transmitting image data from the microprocessor to the buffer storage means;

providing means for transmitting image data from the buffer storage means upon a first predetermined condition being met;

providing a register;

providing the register means for storing image data received from the buffer storage means;

providing means for transmitting image data from the buffer storage means to the register;

providing a print head means;

providing the print head means with at least one printing element;

providing means for transmitting image data from the register to the print head means;

providing means for activating at least one printing element to permit the printing of an image onto a carrier;

said method further comprising the steps of:

inputting data into an input source;

transmitting the input data to the microprocessor;

converting the input data into image data;

transmitting image data from the microprocessor to the buffer storage means;

storing and buffering the image data in the buffer storage means until a first predetermined condition is met;

transmitting the image data from the buffer storage means to the register;

transmitting the image data from the register to the print head means;

activating at least one printing element to permit the printing of an image onto a carrier.

18. The method of operating a thermal printer according to claim 17 wherein:

said means for transmitting image data from said microprocessor to said buffer storage means comprises a parallel data line for transmitting data in parallel, substantially simultaneously among a plurality of connected wires;

said buffer storage means comprises a load state monitoring circuit;

said load state monitoring circuit comprises means for transmitting image data from said buffer storage means to said register upon a first predetermined condition being met in said buffer storage means;

the means for transmitting image data from said buffer storage means to said register comprises means for transmitting image data in serial form, sequentially over one line.

19. The method of operating a thermal printer according to claim 18 wherein:

said microprocessor comprises means for controlling at least one additional print head means and means for moving the carrier into contact with said at least one additional print head means;

at least one said at least one additional print head means comprising at least one color print head means;

said at least one additional print head means and means for moving the carrier into contact with said additional print head means to produce color images.

20. The method of operating a thermal printer according to claim 19 wherein:

said first predetermined condition comprises a predetermined quantity of image data for transmission of image data from said storage buffer means to said register, and said buffer storage means comprises means for generating a signal for transmitting data from said buffer storage means to said register upon said first predetermined condition being met;

said register means comprises register elements for accepting image data;

said register elements capable of storing a sufficient quantity of image data to print the image data onto a carrier;

said quantity of stored image data sufficient to print stored image data stored in said register elements onto a carrier, comprising a second predetermined condition;

said quantity of data relating to said first predetermined condition is less than said quantity of data relating to said second predetermined condition;

said microprocessor comprises means for transmitting image data into said buffer storage means concurrently with the transmitting of image data from said buffer storage means to said register;

said microprocessor comprises means for stopping transmission of image data to said buffer storage means upon said second predetermined condition being met;

said microprocessor comprises means to begin transmitting additional image data to the buffer storage means after at least part of the image data in said buffer storage means is transmitted from said buffer storage means to said register;

said buffer storage means comprises means for transmitting image data from said buffer storage means to said register in the same time order in which the image data was transmitted from said microprocessor to said buffer storage means to provide first-in-first-out storage;

said print head means comprises at least one input;

at least one of:
said microprocessor and
said load state monitoring circuit comprises an output operatively connected to the input of said print head means;

said microprocessor comprises means for generating a print release signal;

a print release signal circuit;

said microprocessor being connected for transmitting print release signals to said print release signal circuit;

said print release signal circuit comprises means for generating a signal comprising an initial continuous pulse followed by rectangular pulses of a higher frequency when a print release signal is received from said microprocessor;

said load state monitoring circuit comprises means for transmitting said print release signal;

means for transmitting said print release signal to said print release signal circuit;

said print head means comprises a sensor for measuring the temperature of said print head means;

means for connecting said temperature sensor to said microprocessor;

said microprocessor comprises means for varying the signal generated by said print release signal circuit based upon temperature data received from said temperature sensor;

means for determining at least one of:
speed of printing an image by said print head means onto a carrier and
at least one characteristic of a carrier to be printed upon;

means for transmitting the determined information determined by said means for determining to said microprocessor;

said microprocessor comprises means for varying the signal generated by said print release signal circuit based upon the determined information determined by said means for determining;

said print head means;

platen roll means;

said platen roll means comprising means for moving the carrier into contact with said print head means;

a stepping motor;

said stepping motor comprising means for rotating said platen roll means;

a pulse generator;

said pulse generator comprising means for generating a signal to energize said rotating means thus running said stepping motor;

means for connecting said platen roll to said stepping motor;

means for connecting said stepping motor to said pulse generator;

means for connecting said pulse generator to said microprocessor;

said microprocessor comprises means for generating a start signal for transmission to said pulse generator.

* * * * *